US012173918B2

(12) United States Patent
Tsuji et al.

(10) Patent No.: US 12,173,918 B2
(45) Date of Patent: Dec. 24, 2024

(54) AIR-CONDITIONING APPARATUS AND AIR HANDLING UNIT

(71) Applicant: Mitsubishi Electric Corporation, Tokyo (JP)

(72) Inventors: Yusuke Tsuji, Tokyo (JP); Kimitaka Kadowaki, Tokyo (JP); Koji Azuma, Tokyo (JP); Yasushi Okoshi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 859 days.

(21) Appl. No.: 16/965,736

(22) PCT Filed: Feb. 22, 2018

(86) PCT No.: PCT/JP2018/006367
§ 371 (c)(1),
(2) Date: Jul. 29, 2020

(87) PCT Pub. No.: WO2019/163042
PCT Pub. Date: Aug. 29, 2019

(65) Prior Publication Data
US 2021/0033302 A1 Feb. 4, 2021

(51) Int. Cl.
*F24F 11/74* (2018.01)
*F24F 1/0059* (2019.01)
(Continued)

(52) U.S. Cl.
CPC ..... *F24F 11/74* (2018.01); *F24F 1/0059* (2013.01); *F24F 2110/10* (2018.01);
(Continued)

(58) Field of Classification Search
CPC ..... F24F 11/74; F24F 1/0059; F24F 2110/10; F24F 2221/54; F24F 2140/20;
(Continued)

(56) References Cited

U.S. PATENT DOCUMENTS 4,507,938 A * 4/1985 Hama ..... F25B 29/003 62/324.1
5,758,514 A 6/1998 Genung et al.
(Continued)

FOREIGN PATENT DOCUMENTS

CN 102236324 A * 11/2011
EP 1134523 A1 9/2001
(Continued)

OTHER PUBLICATIONS

Funada, Air Conditioner, Jan. 31, 2002, JP2002031371A, Whole Document (Year: 2002).*
(Continued)

*Primary Examiner* — Larry L Furdge
(74) *Attorney, Agent, or Firm* — Posz Law Group, PLC

(57) ABSTRACT

An air-conditioning apparatus includes a heat source side unit configured to heat or cool a heat medium used as a heat-conveying medium, an air handling side heat exchanger that exchanges heat between outside air that is sent into a building and the heat medium, and an indoor side heat exchanger that exchanges heat between indoor air and the heat medium. The heat source side unit, the air handling side heat exchanger, and the indoor side heat exchanger are connected by piping to each other to form a heat medium cycle circuit through which the heat medium circulates. In the heat medium cycle circuit, a portion of the heat medium heated or cooled by the heat source side unit flows into the indoor side heat exchanger after having passed through the air handling side heat exchanger.

18 Claims, 10 Drawing Sheets

(51) Int. Cl.
*F24F 110/10* (2018.01)
*F25B 1/04* (2006.01)
*F25B 30/02* (2006.01)

(52) U.S. Cl.
CPC ..... *F24F 2221/54* (2013.01); *F25B 1/04* (2013.01); *F25B 30/02* (2013.01); *F25B 2313/0231* (2013.01); *F25B 2600/2513* (2013.01)

(58) Field of Classification Search
CPC ... F24F 11/84; F25B 1/04; F25B 30/02; F25B 2313/0231; F25B 2600/2513; F25B 25/005; F25B 49/02; F25B 2313/003; F25B 13/00
See application file for complete search history.

(56) References Cited

U.S. PATENT DOCUMENTS

2008/0023961 A1* 1/2008 Cho ..... F24D 18/00 62/324.1
2012/0006050 A1* 1/2012 Takayama ..... F25B 13/00 165/96
2012/0125029 A1* 5/2012 Moreau ..... F24D 3/18 62/238.7
2013/0264044 A1* 10/2013 Kearney ..... H05K 7/20836 165/200
2014/0318163 A1* 10/2014 Takayama ..... F25B 49/00 62/196.1
2015/0034730 A1* 2/2015 Minamisako ..... F24D 19/1072 237/19
2015/0176876 A1* 6/2015 Tamura ..... F25B 30/02 62/196.1
2017/0082334 A1* 3/2017 Kawagoe ..... F25B 1/00
2017/0090485 A1* 3/2017 Ohashi ..... G05D 7/0635

FOREIGN PATENT DOCUMENTS

| | | | | |
|---|---|---|---|---|
| EP | 2116788 | A2 | | 11/2009 |
| EP | 2148155 | A1 | | 1/2010 |
| JP | H05-054921 | U | | 7/1993 |
| JP | H05-54921 | U | | 7/1993 |
| JP | H06-094267 | A | | 4/1994 |
| JP | 2001-227798 | A | | 8/2001 |
| JP | 2002031371 | | * | 1/2002 |
| JP | 2006-200812 | A | | 8/2006 |
| JP | 2009-162411 | A | | 7/2009 |
| JP | 2013-092282 | A | | 5/2013 |
| JP | 2013-224794 | A | | 10/2013 |

OTHER PUBLICATIONS

Weidong et al., Thermal Power Distribution Valve for Fluid Heat Exchanger, CN102236324A, Whole Document (Year: 2011).*
International Search Report of the International Searching Authority mailed May 1, 2018 for the corresponding International application No. PCT/JP2018/006367 (and English translation).
Office Action dated May 13, 2022 issued in corresponding European Patent Application No. 18907175.6.
Office Action dated Apr. 27, 2021 issued in corresponding JP patent application No. 2020-501914 (and English translation).
Extended European Search Report dated Jan. 20, 2021 issued in corresponding European patent application No. 18907175.6.

* cited by examiner

AIR-CONDITIONING APPARATUS AND AIR HANDLING UNIT

CROSS REFERENCE TO RELATED APPLICATION

This application is a U.S. national stage application of International Application No. PCT/JP2018/006367, filed on Feb. 22, 2018, the contents of which are incorporated herein by reference.

TECHNICAL FIELD

The present disclosure relates to air-conditioning apparatuses and air handling units and, in particular, to an air-conditioning apparatus including an air handling unit and an indoor unit.

BACKGROUND

As an air-conditioning apparatus, an air handling unit (AHU) may be used that adjusts, for example, the humidity of air outside an air-conditioned space and supplies the air to the air-conditioned space. The air handling unit is often used in combination with a unit, such as a chiller, that performs heat supply, for example, with heated or cooled water. In so doing, the air handling unit utilizes sensible heat, for example, in water to exchange heat with the air that is outside the air-conditioned space and is a heat load.

Meanwhile, there is an indoor unit that adjusts, for example, the temperature of air in an air-conditioned space and supplies the air to the air-conditioned space. The indoor unit is often connected by piping to an outdoor unit that circulates refrigerant. In so doing, the indoor unit utilizes, for example, latent heat of the refrigerant to exchange heat with the air that is in the air-conditioned space and is a heat load. Further, there is an air-conditioning apparatus that performs air conditioning by circulating, for example, water through a circuit formed by a combination of an indoor unit and an air handling unit (see, for example, Patent Literature 1).

PATENT LITERATURE

Patent Literature 1: Japanese Unexamined Utility Model Registration Application Publication No. 5-054921

However, in Paten Literature 1 mentioned above, the indoor unit and the air handling unit are not cooperative as a configuration. This has made it necessary, for example, to supply more heat to a heat medium than to a heat load, and such imbalance in heat supply has resulted in wasteful consumption of energy.

SUMMARY

To solve problems such as those described above, the present disclosure has as an object to provide an air-conditioning apparatus and an air handling unit that make it possible to achieve energy saving.

An air-conditioning apparatus according to an embodiment of the present disclosure includes a heat source side unit configured to heat or cool a heat medium used as a heat-conveying medium, an air handling side heat exchanger that exchanges heat between outside air that is sent into a building and the heat medium, and an indoor side heat exchanger that exchanges heat between indoor air and the heat medium. The heat source side unit, the air handling side heat exchanger, and the indoor side heat exchanger are connected by piping to each other to form a heat medium cycle circuit through which the heat medium circulates. In the heat medium cycle circuit, a portion of the heat medium heated or cooled by the heat source side unit flows into the indoor side heat exchanger after having passed through the air handling side heat exchanger. The heat medium cycle circuit is provided with an air handling side flow rate control device configured to adjust a flow rate of the heat medium that passes through the air handling side heat exchanger.

In an embodiment of the present disclosure, the heat medium cycle circuit, which performs air conditioning by circulating the heat medium, is configured in such a manner that a flow of the heat medium heated or cooled by the heat source side unit is allowed to pass through the air handling side heat exchanger, in which there is only a small change in amount of heat that is exchanged, first and to then enter the indoor side heat exchanger. This makes it possible to efficiently perform heat supply.

DETAILED DESCRIPTION

Figure 1:
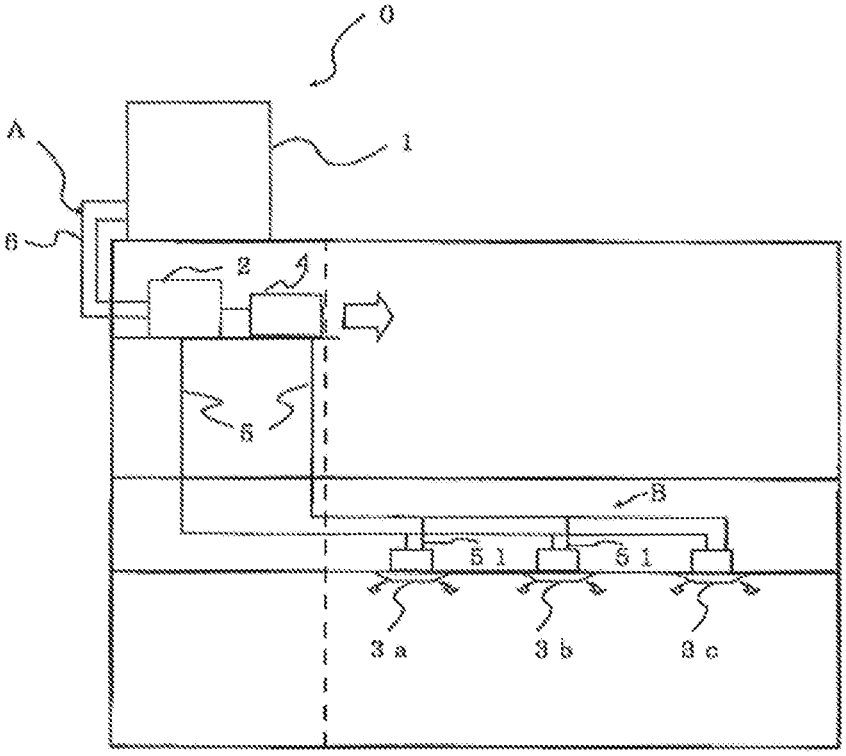
FIG. 1 is a schematic view showing an example of installation of an air-conditioning apparatus 0 according to Embodiment 1 of the present disclosure.

In the following, air-conditioning apparatuses according to embodiments of the present disclosure are described, for example, with reference to the drawings. In the following drawings, the same reference signs are assigned to identical or equivalent constituent parts and these reference signs are common throughout the full text of the embodiments to be described below. Further, relationships in size between constituent parts in the drawings may be different from actual relationships in size between the constituent parts. Moreover, the forms of constituent elements described in the full text of the specification are mere examples and are thus not limited to the forms described in the specification. In particular, combinations of constituent elements are not limited solely to combinations in each embodiment, and a constituent element described in another embodiment can be applied to a different embodiment. Further, how high or low a pressure and a temperature are is not particularly determined in relation to absolute values but relatively determined, for example, in terms of states and actions in apparatuses or other devices. Pieces of equipment or other devices of the same sort that are for example differentiated by subscripts may be described with omission of, for example, subscripts in a case where the pieces of equipment or other devices do not particularly need to be differentiated or identified.

Embodiment 1

FIG. 1 is a schematic view showing an example of installation of an air-conditioning apparatus 0 according to Embodiment 1 of the present disclosure. The example of installation of the air-conditioning apparatus 0 according to Embodiment 1 is described with reference to FIG. 1. The air-conditioning apparatus 0 includes a heat source side refrigerant cycle circuit A through which heat source side refrigerant circulates and a heat medium cycle circuit B through which a heat medium such as water circulates. The refrigerant that circulates through the heat source side refrigerant cycle circuit A heats or cools the heat medium in the heat medium cycle circuit B. Furthermore, the heat medium thus heated or cooled performs air conditioning by cooling or heating a room.

In FIG. 1, the air-conditioning apparatus 0 according to Embodiment 1 includes a single outdoor unit 1 used as a heat source device, a plurality of indoor units 3 (indoor units 3*a* to 3*c*), an air handling unit 4, and a relay unit 2. The relay unit 2 is a unit that relays the transfer of heat between the heat source side refrigerant that circulates through the heat source side refrigerant cycle circuit A and the heat medium that circulates through the heat medium cycle circuit B. The outdoor unit 1 and the relay unit 2 are connected to each other by a refrigerant pipe 6 used as a flow passage of the heat source side refrigerant. Note here that a parallel arrangement of a plurality of the relay units 2 may be connected to the single outdoor unit 1. In Embodiment 1, the outdoor unit 1 and the relay unit 2 correspond to a heat source side unit of the present disclosure.

Figure 2:
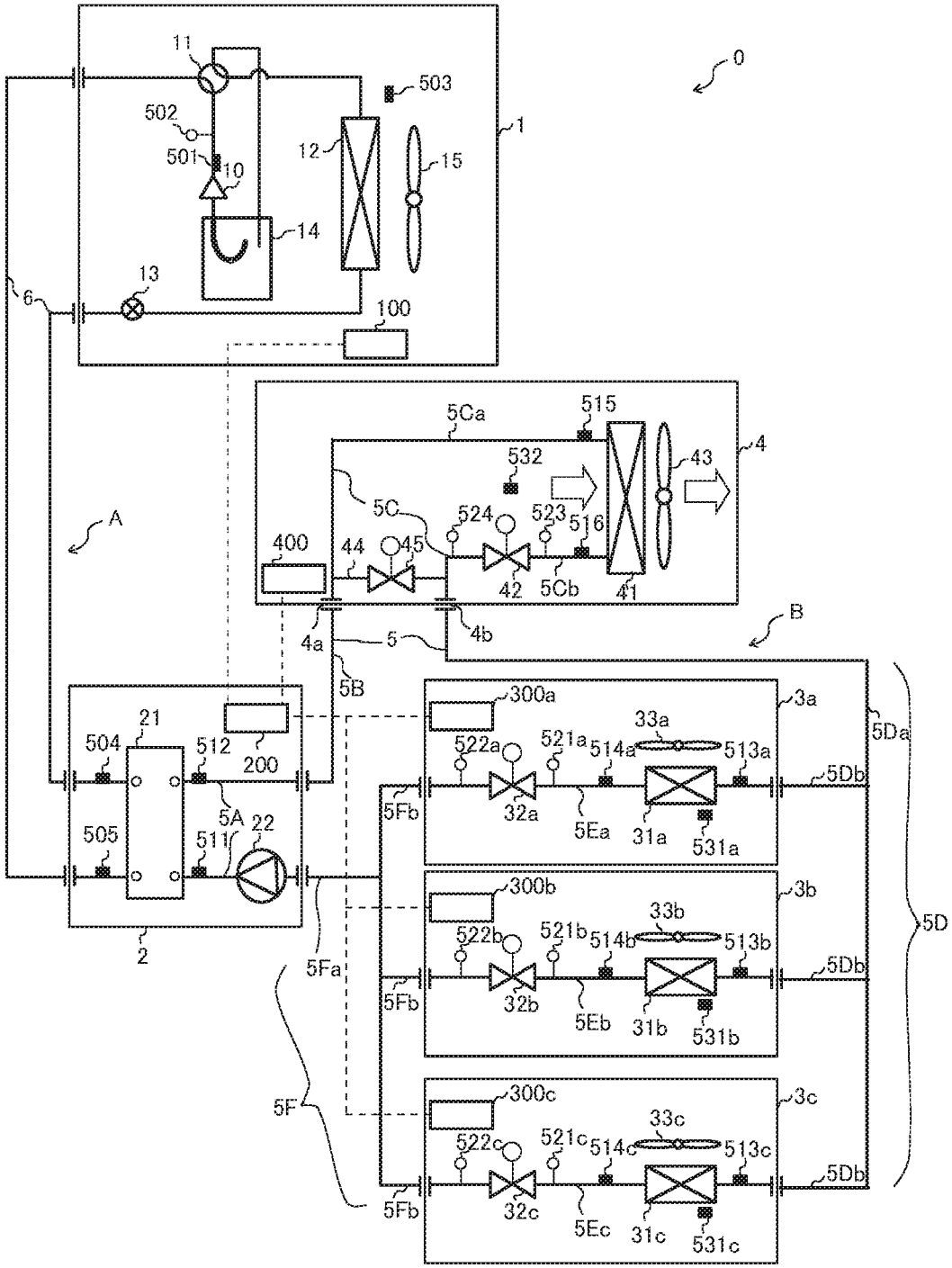
FIG. 2 is a diagram showing an example of a configuration of the air-conditioning apparatus 0 according to Embodiment 1 of the present disclosure.

Further, the air-conditioning apparatus 0 includes a heat medium pipe 5 that includes a pipe laid inside the relay unit 2, each indoor unit 3, and the air handling unit 4 and a pipe connecting one unit to another and that is used as a flow passage of the heat medium. Note here that as shown in FIG. 2, which will be described later, the heat medium pipe 5 includes a relay unit inner pipe 5A, a first connecting pipe 5B, an air handling unit inner pipe 5C, a second connecting pipe 5D, indoor unit inner pipes 5E (indoor unit inner pipes 5Ea to 5Ec), and a third connecting pipe 5F. The relay unit inner pipe 5A is a pipe laid in the relay unit 2. The first connecting pipe 5B is a pipe connecting the relay unit 2 with the air handling unit 4. The air handling unit inner pipe 5C is a pipe laid in the air handling unit 4. The second connecting pipe 5D is a pipe connecting the air handling unit 4 with the indoor units 3. The indoor unit inner pipes 5E are pipes laid in the indoor units 3. The third connecting pipe 5F is a pipe connecting the relay unit 2 with the indoor units 3. Further, the second connecting pipe 5D includes a single main pipe 5Da connected to the air handling unit 4 and branch pipes 5Db branching off from the main pipe 5Da and connected to each separate indoor unit 3. Further, the third connecting pipe 5F includes a single main pipe 5Fa connected to the relay unit 2 and branch pipes 5Fb branching off from the main pipe 5Fa and connected to each separate indoor unit 3. Moreover, in the heat medium cycle circuit B of Embodiment 1, the air handling unit 4 and each indoor unit 3 are connected by piping so that the air handling unit 4 is situated upstream and each indoor unit 3 is situated downstream in the flow of the heat medium heated or cooled by the transfer of heat by the heat source side refrigerant cycle circuit A when a heat medium heat exchanger 21, which will be described later, is defined as a starting point of the flow of the heat medium.

Usable examples of the heat source side refrigerant that circulates through the heat source side refrigerant cycle circuit A include single-component refrigerants such as R-22 and R-134a, near-azeotropic refrigerant mixtures such as R-410A and R-404A, and non-azeotropic refrigerant mixtures such as R-407C. Other usable examples include a refrigerant, such as $CF_3CF{=}CH_2$, whose chemical formula includes a double bond and whose global warming potential is comparatively small, a mixture of such refrigerants, and a natural refrigerant such as $CO_2$ or propane.

Further, usable examples of the heat medium that circulates through the heat medium cycle circuit B include brine (antifreeze), water, a liquid mixture of brine and water, and a liquid mixture of a highly anticorrosive additive and water. Thus, the air-conditioning apparatus 0 of Embodiment 1 allows use of a highly safe heat medium. For this reason, the air-conditioning apparatus 0 according to Embodiment 1 is safe, for example, even if the heat medium leaks into an air-conditioned space via an indoor unit 3. Further, brine (antifreeze), water, a liquid mixture of brine and water, or a liquid mixture of a highly anticorrosive additive and water more hardly involves a change of phase than the aforementioned heat source side refrigerant even when an air handling side heat exchanger 41 and an indoor side heat exchanger 31, both of which will be described later, exchange heat.

Next, operation of the air-conditioning apparatus 0 is described with reference to FIG. 1. The outdoor unit 1 circulates the heat source side refrigerant to and from the relay unit 2 through the refrigerant pipe 6. At this point in time, the heat source side refrigerant exchanges heat with the heat medium in passing through the heat medium heat exchanger 21, which will be described later, in the relay unit 2. The heat medium is heated or cooled by the heat exchange. In Embodiment 1, the heat source side refrigerant is heated, and the heat medium is cooled.

The heat medium cooled in the relay unit 2 is circulated by a pump 22, which will be described later, to and from each indoor unit 3 and the air handling unit 4 through the heat medium pipe 5. At this point in time, the heat medium exchanges heat with air sent by fans in the air handling side heat exchanger 41, which will be described later, in the air handling unit 4 and the indoor side heat exchangers 31, which will be described later, in the indoor units 3. The air with which the heat medium has exchanged heat is used for air conditioning of air-conditioned spaces. Note here that the indoor units 3 and the air handling unit 4 are defined to be targeted at different air-conditioned spaces. For this reason, the spaces on which the indoor units 3 perform air conditioning are described as indoor spaces, and air in the indoor spaces is described as indoor air. Further, the space on which the air handling unit 4 performs air conditioning is described as a targeted space. Note, however, that the indoor spaces and the targeted space may be the same space.

FIG. 2 is a diagram showing an example of a configuration of the air-conditioning apparatus 0 according to Embodiment 1 of the present disclosure. A configuration of pieces of equipment or other devices of the air-conditioning apparatus 0 is described with reference to FIG. 2. As mentioned above, the outdoor unit 1 and the relay unit 2 are connected to each other by the refrigerant pipe 6. Further, the relay unit 2, each indoor unit 3, and the air handling unit 4 are connected to one another by the heat medium pipe 5. Note here that in FIG. 2, three indoor units 3 are connected to the relay unit 2 via the heat medium pipe 5. Note, however, that the number of indoor units 3 that are connected is not limited to three.

[Outdoor Unit 1]

First, a configuration of the outdoor unit 1 is described. The outdoor unit 1 is a unit that conveys heat by circulating the heat source side refrigerant through the heat source side refrigerant cycle circuit A and causes the heat source side refrigerant to exchange heat with the heat medium in the heat medium heat exchanger 21 of the relay unit 2. In Embodiment 1, cooling energy is conveyed by the heat source side refrigerant. The outdoor unit 1 includes a compressor 10, a refrigerant flow switching device 11, a heat source side heat exchanger 12, an expansion device 13, and an accumulator 14 inside a housing. The compressor 10, the refrigerant flow switching device 11, the heat source side heat exchanger 12, the expansion device 13, and the accumulator 14 are mounted by being connected to one another by piping through the refrigerant pipe 6. The compressor 10 suctions the heat source side refrigerant, compresses it, brings it into a high-temperature and high-pressure state, and discharges it. Note here that the compressor 10 may be, for example, a capacity-controllable inverter compressor.

The heat source side heat exchanger 12 exchanges heat, for example, between outside air supplied from a heat source side fan 15 and the heat source side refrigerant. In a heating operation mode, the heat source side heat exchanger 12 is used as an evaporator to cause the heat source side refrigerant to receive heat. Further, in a cooling operation mode, the heat source side heat exchanger 12 is used as a condenser or a radiator to cause the heat source side refrigerant to reject heat.

Further, the expansion device 13 is a device that is used as a pressure reducing valve and an expansion valve to expand the heat source side refrigerant under reduced pressure. Note here that a preferred example of the expansion device 13 is a device, such as an electronic expansion valve, that can control an opening degree to any extent and can arbitrarily adjust, for example, the flow rate of the heat source side refrigerant.

The accumulator 14 is provided to a suction port of the compressor 10. The accumulator 14 stores, for example, a difference between the amount of refrigerant that is used in the heating operation mode and the amount of refrigerant that is used in the cooling operation mode and an excess of refrigerant that is caused during a transition period of change in operation. In some cases, the accumulator 14 is not installed in the heat source side refrigerant cycle circuit A.

Further, the outdoor unit 1 includes an outdoor unit control device 100. The outdoor unit control device 100 exercises at least control of the capacity of the compressor 10. Further, the outdoor unit control device 100 may additionally include a component that controls the opening degree of the expansion device 13, a flow passage of the refrigerant flow switching device 11, or the air flow rate of the heat source side fan 15.

Further, the outdoor unit 1 includes a discharge temperature sensor 501, a discharge pressure sensor 502, and an outdoor temperature sensor 503. The discharge temperature sensor 501 is a sensor that detects the temperature of refrigerant that is discharged by the compressor 10, and outputs, to the outdoor unit control device 100, a discharge temperature detection signal representing data containing the temperature thus detected. The discharge pressure sensor 502 is a sensor that detects the pressure of refrigerant that is discharged by the compressor 10, and outputs, to the outdoor unit control device 100, a discharge pressure detection signal representing data containing the pressure thus detected. The outdoor temperature sensor 503 is a sensor that detects an outdoor unit side outdoor temperature representing the temperature of the area surrounding the outdoor unit 1, and outputs, to the outdoor unit control device 100, an outdoor unit side outdoor temperature detection signal containing the temperature thus detected.

[Relay Unit 2]

Next, a configuration of the relay unit 2 is described. The relay unit 2 is a unit that includes pieces of equipment responsible for the transfer of heat between the heat source side refrigerant that circulates through the heat source side refrigerant cycle circuit A and the heat medium that circulates through the heat medium cycle circuit B. The relay unit 2 includes the heat medium heat exchanger 21 and the pump 22.

The heat medium heat exchanger 21 heats or cools the heat medium by exchanging heat between the heat source side refrigerant and the heat medium. In heating the heat medium, the heat medium heat exchanger 21 is used as a condenser or a radiator so that the heat source side refrigerant rejects heat to the heat medium. Further, in cooling the heat medium, the heat medium heat exchanger 21 is used as an evaporator so that the heat source side refrigerant receives heat from the heat medium. The pump 22 is a device that suctions the heat medium and presses it into circulation through the heat medium cycle circuit B. Note here that the pump 22 can exercise capacity control so that the flow rate of the heat medium that circulates through the heat medium cycle circuit B can be adjusted depending on the magnitude of heat loads in each indoor unit 3 and the air handling unit 4.

The relay unit 2 includes a relay unit control device 200. The relay unit control device 200 exercises at least control of the capacity of the pump 22.

The relay unit 2 includes a first refrigerant temperature sensor 504, a second refrigerant temperature sensor 505, a heat medium inlet side temperature sensor 511, and a heat medium outlet side temperature sensor 512. The first refrigerant temperature sensor 504 is a sensor that detects the temperatures of heat source side refrigerant that flows into the heat medium heat exchanger 21 in a case where the heat medium is cooled and heat source side refrigerant that flows out from the heat medium heat exchanger 21 in a case where the heat medium is heated, and outputs, to the relay unit control device 200, a first refrigerant temperature detection signal representing data containing the temperatures thus detected. The second refrigerant temperature sensor 505 is a sensor that detects the temperatures of heat source side refrigerant that flows out from the heat medium heat exchanger 21 in a case where the heat medium is cooled and heat source side refrigerant that flows into the heat medium heat exchanger 21 in a case where the heat medium is heated, and outputs, to the relay unit control device 200, a second refrigerant temperature detection signal representing data containing the temperatures thus detected. The heat medium inlet side temperature sensor 511 is a sensor that detects the temperature of a heat medium that flows into the heat medium heat exchanger 21, and outputs, to the relay unit control device 200, a heat medium inflow temperature detection signal representing data containing the temperature thus detected. The heat medium outlet side temperature sensor 512 is a sensor that detects the temperature of a heat medium that flows out from the heat medium heat exchanger 21, and outputs, to the relay unit control device 200, a heat medium outflow temperature detection signal representing data containing the temperature thus detected.

[Indoor Unit 3]

Next, a configuration of each of the indoor units 3 is described. Each of the indoor units 3 is a unit that conditions air in an air-conditioned space and sends the air into the air-conditioned space. In Embodiment 1, each indoor unit 3 includes an indoor side heat exchanger 31 (indoor side heat exchanger 31*a* to indoor side heat exchanger 31*c*), an indoor side flow rate control device 32 (indoor side flow rate control device 32*a* to indoor side flow rate control device 32*c*), and an indoor side fan 33 (indoor side fan 33*a* to indoor side fan 33*c*) inside a housing. The indoor side heat exchanger 31 and the indoor side flow rate control device 32 are used as pieces of equipment that are included in the heat medium cycle circuit B.

The indoor side flow rate control device 32 is, for example, a two-way valve whose opening degree (opening area) can be controlled. By adjusting the opening degree, the indoor side flow rate control device 32 controls the flow rate of a heat medium that flows into and out from the indoor side heat exchanger 31. Moreover, the indoor side flow rate control device 32 adjusts, on the basis of the temperature of a heat medium that flows into the indoor unit 3 and the temperature of a heat medium that flows out from the indoor unit 3, the amount of a heat medium that passes through the indoor side heat exchanger 31 so that the indoor side heat exchanger 31 can exchange heat by an amount of heat corresponding to an indoor heat load. Note here that when the indoor side heat exchanger 31 does not need to exchange heat with a heat load, e.g. during stoppage or a thermo-off state, which will be described later, the indoor side flow rate control device 32 can fully close the valve to stop the supply so that the heat medium does not flow into or out from the indoor side heat exchanger 31. Although, in FIG. 2, the indoor side flow rate control device 32 is installed at a pipe connected to a heat medium outflow port of the indoor side heat exchanger 31, this is not intended to impose any limitation. For example, the indoor side flow rate control device 32 may be installed to a heat medium inflow port of the indoor side heat exchanger 31.

Further, the indoor side heat exchanger 31 includes, for example, a heat-transfer pipe and a fin. Moreover, the heat medium passes through the inside of the heat-transfer pipe of the indoor side heat exchanger 31. The indoor side heat exchanger 31 exchanges heat between air in an indoor space that is supplied from the indoor side fan 33 and the heat medium. When the heat medium that is colder than the air passes through the inside of the heat-transfer pipe, the air is caused to be cooled and the indoor space is caused to be cooled. The indoor side fan 33 allows the air in the indoor space to pass through the indoor side heat exchanger 31 and thereby generates a current of air that returns to the indoor space.

Further, each indoor unit 3 includes an indoor unit control device 300 (indoor unit control device 300*a* to indoor unit control device 300*c*). The indoor unit control device 300 exercises at least control of the opening degree of the indoor side flow rate control device 32. Further, the indoor unit control device 300 may additionally include a component that controls the air flow rate of the indoor side fan 33.

Further, each indoor unit 3 includes an indoor inlet side temperature sensor 513 (indoor inlet side temperature sensor 513*a* to indoor inlet side temperature sensor 513*c*), an indoor outlet side temperature sensor 514 (indoor outlet side temperature sensor 514*a* to indoor outlet side temperature sensor 514*c*), an indoor inlet side pressure sensor 521 (indoor inlet side pressure sensor 521*a* to indoor inlet side pressure sensor 521*c*), an indoor outlet side pressure sensor 522 (indoor outlet side pressure sensor 522*a* to indoor outlet side pressure sensor 522*c*), and an indoor temperature sensor 531 (indoor temperature sensor 531*a* to indoor temperature sensor 531*c*).

Each indoor inlet side temperature sensor 513 is a sensor that detects the temperature of a heat medium that flows into the indoor side heat exchanger 31, and outputs, to the indoor unit control device 300, an indoor inflow side temperature detection signal representing data containing the temperature thus detected. Each indoor outlet side temperature sensor 514 is a sensor that detects the temperature of a heat medium that flows out from the indoor side heat exchanger 31, and outputs, to the indoor unit control device 300, an indoor outflow side temperature detection signal representing data containing the temperature thus detected. Each indoor inlet side pressure sensor 521 is a sensor that detects the pressure of a heat medium that flows into the indoor side flow rate control device 32, and outputs, to the indoor unit control device 300, an indoor inflow side pressure detection signal representing data containing the pressure thus detected. Each indoor outlet side pressure sensor 522 is a sensor that detects the pressure of a heat medium that flows out from the indoor side flow rate control device 32, and outputs, to the indoor unit control device 300, an indoor outflow side pressure detection signal representing data containing the pressure thus detected. Each indoor temperature sensor 531 is a sensor that detects the temperature of indoor air that exchanges heat with the heat medium in the indoor side heat exchanger 31, and outputs, to the indoor unit control device 300, an indoor temperature detection signal representing data containing the temperature thus detected.

[Air Handling Unit 4] The air handling unit 4 is an air handling unit that conditions air outside a targeted space (hereinafter referred to as "outside air") and sends the air into the targeted space. The air handling unit 4 can, for example, send the outside air into the targeted space with a humidity adjustment. The air handling unit 4 includes the air handling unit inner pipe 5C, the air handling side heat exchanger 41, an air handling side flow rate control device 42, a bypass pipe 44, a bypass side flow rate control device 45, and an air handling side fan 43. Further, the air handling unit 4 has an inlet 4*a* through which a heated or cooled heat medium flows in from the relay unit 2 and an outlet 4*b* through which a heat medium having passed through the air handling side heat exchanger 41 flows out. Further, the air handling unit inner pipe 5C is formed by an inward path pipe 5Ca connecting the inlet 4*a* with the air handling side heat exchanger 41 and an outward path pipe 5Cb connecting the air handling side heat exchanger 41 with the outlet 4*b*. The air handling side heat exchanger 41 exchanges heat between a heat medium that passes through the inside of a heat-transfer pipe and outside air that passes through the outside of the heat-transfer pipe.

The air handling side flow rate control device 42 is, for example, a two-way valve whose opening degree (opening area) can be controlled. By adjusting the opening degree, the air handling side flow rate control device 42 controls the flow rate of a heat medium that flows into and out from the air handling side heat exchanger 41. To increase the amount of heat that is exchanged in the air handling side heat exchanger 41, the air handling side flow rate control device 42 is controlled so that the opening degree is increased, and to reduce the amount of heat that is exchanged in the air handling side heat exchanger 41, the air handling side flow rate control device 42 is controlled so that the opening degree is reduced. Note here that when the air handling side heat exchanger 41 does not need to exchange heat with the outside air that is a heat load, the air handling side flow rate control device 42 can fully close the valve to stop the supply so that the heat medium does not flow into or out from the air handling side heat exchanger 41.

Further, the bypass pipe 44 is a pipe running parallel to the air handling side heat exchanger 41 and connecting the inward path pipe 5Ca with the outward path pipe 5Cb. The bypass pipe 44 causes the heat medium not to pass through the air handling side heat exchanger 41 and thus to bypass the air handling side heat exchanger 41 in the heat medium cycle circuit B. Furthermore, the bypass side flow rate control device 45 adjusts its opening degree and thereby controls the flow rate of a heat medium that passes through the bypass pipe 44. Moreover, the air handling side fan 43 allows the outside air to pass through the air handling side heat exchanger 41 and thereby generates a current of air that is sent to the targeted space.

Further, the air handling unit 4 includes an air handling unit control device 400. The air handling unit control device 400 exercises at least control of the opening degree of the air handling side flow rate control device 42. Further, the air handling unit control device 400 may additionally include a component that controls the opening degree of the bypass side flow rate control device 45 or the air flow rate of the air handling side fan 43.

Furthermore, the air handling unit control device 400 has stored a predetermined air handling side set temperature in the air handling unit control device 400. The air handling unit control device 400 exercises control so that the temperature of the targeted space reaches the air handling side set temperature. The air handling side set temperature may be determined in advance by a user with an input device such as a remote controller or may be determined in advance at the time of installation of the air handling unit 4. Further, the air handling side set temperature may be set at different values, one of which is for cooling the outside air and the other one of which is for heating the outside air.

Further, the air handling unit 4 includes an air handling inlet side temperature sensor 515, an air handling outlet side temperature sensor 516, an air handling inlet side pressure sensor 523, an air handling outlet side pressure sensor 524, and an outside air temperature sensor 532. The air handling inlet side temperature sensor 515 is a sensor that detects the temperature of a heat medium that flows into the air handling side heat exchanger 41, and outputs, to the air handling unit control device 400, an indoor inflow side temperature detection signal representing data containing the temperature thus detected. The air handling outlet side temperature sensor 516 is a sensor that detects the temperature of a heat medium that flows out from the air handling side heat exchanger 41, and outputs, to the air handling unit control device 400, an indoor outflow side temperature detection signal representing data containing the temperature thus detected. The air handling inlet side pressure sensor 523 is a sensor that detects the pressure of a heat medium that flows into the air handling side heat exchanger 41, and outputs, to the air handling unit control device 400, an inflow side pressure detection signal representing data containing the pressure thus detected. The air handling inlet side pressure sensor 523 is a sensor that detects the pressure of a heat medium that flows out from the air handling side heat exchanger 41, and outputs, to the air handling unit control device 400, an outflow side pressure detection signal representing data containing the pressure thus detected. The outside air temperature sensor 532 is a sensor that detects the temperature of outside air with which the heat medium exchanges heat in the air handling side heat exchanger 41, and outputs, to the air handling unit control device 400, an outside air temperature detection signal representing data containing the temperature thus detected.

As will be mentioned later, the air handling unit control device 400 calculates, on the basis of the values detected by the air handling inlet side temperature sensor 515, the air handling outlet side temperature sensor 516, the air handling inlet side pressure sensor 523, and the air handling outlet side pressure sensor 524, the amount of heat that is exchanged in the air handling side heat exchanger 41. Accordingly, the air handling unit control device 400, the air handling inlet side temperature sensor 515, the air handling outlet side temperature sensor 516, the air handling inlet side pressure sensor 523, and the air handling outlet side pressure sensor 524 correspond to an air handling side amount-of-heat detection device of the present disclosure.

As shown in FIG. 2, the outdoor unit control device 100, the relay unit control device 200, the indoor unit control devices 300, and the air handling unit control device 400 are communicably connected to one another by radio or by cable and can communicate signals containing various type of data to and from one another. Although, in FIG. 2, the outdoor unit control device 100, the indoor unit control device 300, and the air handling unit control device 400 are communicably connected to one another via the relay unit control device 200, this is not intended to impose any limitation, and the outdoor unit control device 100, the indoor unit control device 300, and the air handling unit control device 400 may be communicably connected directly to one another. It should be noted that the outdoor unit control device 100 or the relay unit control device 200 corresponds to a heat source side unit control device of the present disclosure.

Operations or other actions that are performed by the pieces of equipment that are included in the heat source side refrigerant cycle circuit A of the air-conditioning apparatus 0 are described here with reference to the flow of the heat source side refrigerant that circulates through the heat source side refrigerant cycle circuit A. First, a case where the heat medium is cooled is described. The compressor 10 suctions the heat source side refrigerant, compresses it, brings it into a high-temperature and high-pressure state, and discharges it. The heat source side refrigerant thus discharged flows into the heat source side heat exchanger 12 via the refrigerant flow switching device 11. The heat source side heat exchanger 12 exchanges heat between air supplied by the heat source side fan 15 and the heat source side refrigerant, and thereby condenses and liquefies the heat source side refrigerant. The heat source side refrigerant thus condensed and liquefied passes through the expansion device 13. The expansion device 13 decompresses the condensed and liquefied heat source side refrigerant passing through the expansion device 13. The heat source side refrigerant thus decompressed flows out from the outdoor unit 1, passes through the refrigerant pipe 6, and flows into the heat medium heat exchanger 21 of the relay unit 2. The heat medium heat exchanger 21 exchanges heat between the heat source side refrigerant passing through the heat medium heat exchanger 21 and the heat medium, and thereby evaporates and gasifies the heat source side refrigerant. At this point in time, the heat medium is cooled. The heat source side refrigerant having flowed out from the heat medium heat exchanger 21 flows out from the relay unit 2, passes through the refrigerant pipe 6, and flows into the outdoor unit 1.

Then, the compressor 10 suctions the evaporated and gasified heat source side refrigerant having passed through the refrigerant flow switching device 11 again.

Next, a case where the heat medium is heated is described. The compressor 10 suctions the heat source side refrigerant, compresses it, brings it into a high-temperature and high-pressure state, and discharges it. The heat source side refrigerant thus discharged flows out from the outdoor unit 1 via the refrigerant flow switching device 11, passes through the refrigerant pipe 6, and flows into the heat medium heat exchanger 21 of the relay unit 2. The heat medium heat exchanger 21 exchanges heat between the heat source side refrigerant passing through the heat medium heat exchanger 21 and the heat medium, and thereby condenses and liquefies the heat source side refrigerant. At this point in time, the heat medium is heated. The heat source side refrigerant having flowed out from the heat medium heat exchanger 21 flows out from the relay unit 2, passes through the refrigerant pipe 6, and passes through the expansion device 13 of the outdoor unit 1. The expansion device 13 decompresses the condensed and liquefied heat source side refrigerant passing through the expansion device 13. The heat source side refrigerant thus decompressed flows into the heat source side heat exchanger 12. The heat source side heat exchanger 12 exchanges heat between air supplied by the heat source side fan 15 and the heat source side refrigerant, and thereby evaporates and gasifies the heat source side refrigerant. Then, the compressor 10 suctions the evaporated and gasified heat source side refrigerant having passed through the refrigerant flow switching device 11 again.

Figure 3:
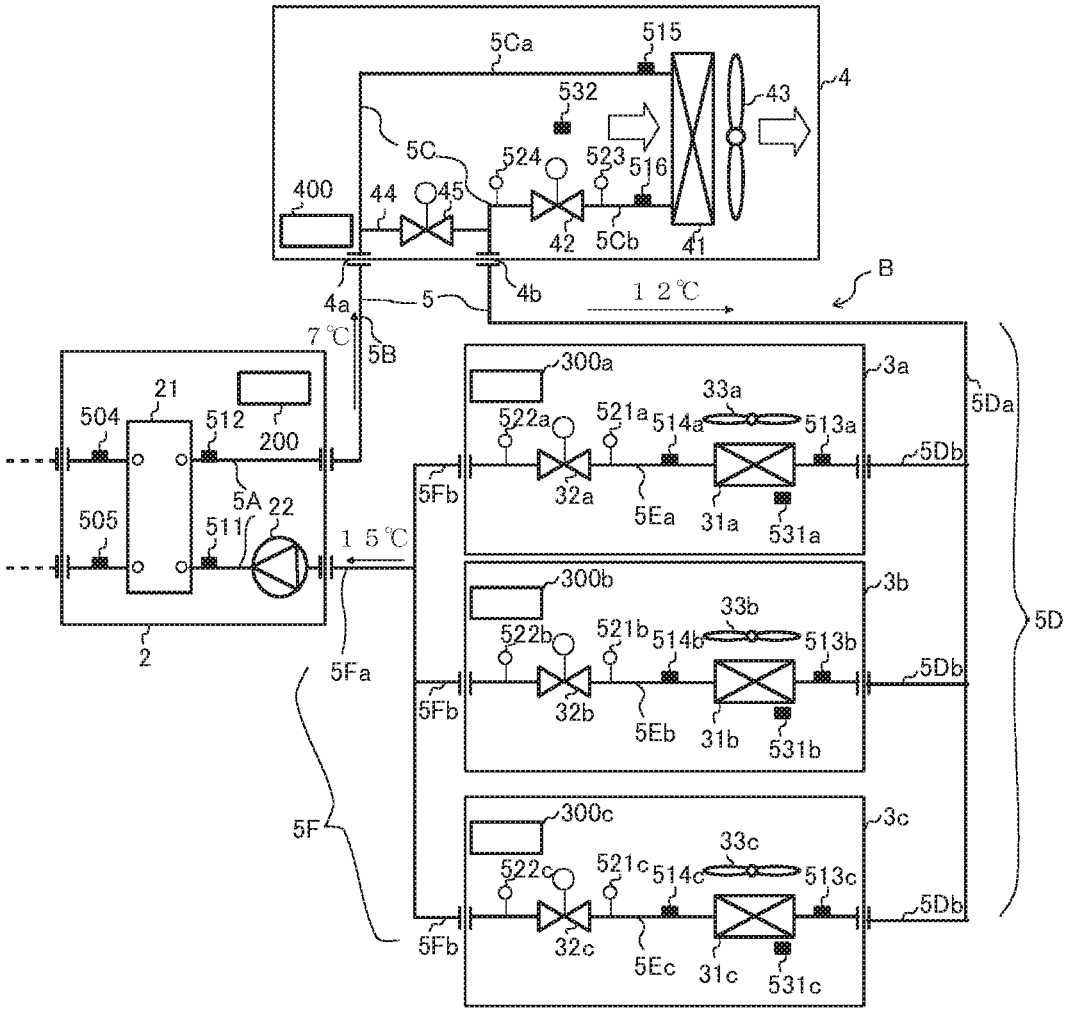
FIG. 3 is a diagram explaining an example of the flow of a heat medium through a heat medium cycle circuit B of the air-conditioning apparatus 0 according to Embodiment 1 of the present disclosure.

Furthermore, operations or other actions that are performed by the pieces of equipment that are included in the heat medium cycle circuit B of the air-conditioning apparatus 0 are described with reference to the flow of the heat medium that circulates through the heat medium cycle circuit B. FIG. 3 is a diagram explaining an example of the flow of the heat medium through the heat medium cycle circuit B of the air-conditioning apparatus 0 according to Embodiment 1 of the present disclosure. A case where a cooled heat medium is circulated is described here. Note here that specific numerical values of temperature are mere examples and are thus not intended to impose any limitation.

Driving of the pump 22 leads to the formation of the flow of the heat medium through the heat medium cycle circuit B. The heat medium pressurized by the pump 22 flows into the heat medium heat exchanger 21, exchanges heat with the heat source side refrigerant in the heat medium heat exchanger 21, and becomes cooled. For illustrative purposes, the heat medium having passed through the heat medium heat exchanger 21 is defined to be cooled to a temperature of 7 degrees Celsius.

The heat medium cooled by the heat medium heat exchanger 21 flows out from the relay unit 2 and flows into the air handling unit 4 via the first connecting pipe 5B. The heat medium having flowed into the air handling unit 4 passes through either the air handling side heat exchanger 41 or the bypass pipe 44. The heat medium having passed through the air handling side heat exchanger 41 exchanges heat with the outside air and increases in temperature by absorbing heat from the outside air. Further, the outside air having exchanged heat with the heat medium drops in temperature and becomes cooled and dehumidified. On the other hand, the heat medium having passed through the bypass pipe 44 does not exchange heat with the outside air, so that the temperature of the heat medium does not change. The heat medium having passed through the air handling side heat exchanger 41 and the heat medium having passed through the bypass pipe 44 converge at the outward path pipe 5Cb and flow out from the air handling unit 4. Accordingly, the temperature of the heat medium that flows out from the air handling unit 4 becomes lower than the temperature of the heat medium having passed through the air handling side heat exchanger 41. For illustrative purposes, the temperature of the heat medium that flows out from the air handling unit 4 is defined as 12 degrees Celsius.

The heat medium having flowed out from the air handling unit 4 flows into any of the indoor units 3*a* to 3*c* via the second connecting pipe 5D. The heat media having flowed into the indoor units 3*a* to 3*c* pass through the respective indoor unit inner pipes 5E and the respective indoor side heat exchangers 31. Each of the heat media having passed through the respective indoor side heat exchangers 31 exchange heat with the indoor air and increases in temperature by absorbing heat from the indoor air. Further, the indoor air having exchanged heat with the heat medium drops in temperature and becomes cooled. The heat media having passed through the respective indoor side heat exchangers 31 flow out from the indoor units 3*a* to 3*c* and flow into the third connecting pipe 5F. The heat media having passed through the respective indoor side heat exchangers 31 converge at the third connecting pipe 5F. The heat media having converged have increased temperatures in the respective indoor side heat exchangers 31. For illustrative purposes, the temperature of the heat media having converged is defined as 15 degrees Celsius.

The heat media having converged at the third connecting pipe 5F flow into the relay unit 2, are pressurized again by the pump 22, and flow into the heat medium heat exchanger 21.

For example, the air handling unit 4, which exchanges heat with the outside air, may dehumidify the outside air and supply it to the air-conditioned space. In this case, the heat medium needs to pass through the air handling side heat exchanger 41 of the air handling unit 4 at a temperature that is lower than the dew-point temperature of the outside air and transfer heat to the outside air. Meanwhile, the temperature of a heat medium that is used for cooling an indoor space may often be higher than the temperature of a heat medium required by the air handling unit 4. As the heat medium cycle circuit B of Embodiment 1 is configured in such a manner that the heat medium cooled by the heat medium heat exchanger 21 flows into the indoor units 3 after having passed through the air handling unit 4, the air handling unit 4, which requires a larger amount of cooling than do the indoor units 3, is less likely to lack a sufficient amount of cooling than in a case where the heat medium passes through the air handling unit 4 after having passed through the indoor units 3.

Further, even in a case where a heated heat medium is circulated, the flow of the heat medium that circulates through the heat medium cycle circuit B is the same as that of FIG. 3. Note, however, that in a case where a heated heat medium is circulated, the heat medium is heated by the heat source side refrigerant in the heat medium heat exchanger 21 and drops in temperature by giving heat to the indoor air or the outside air in the indoor side heat exchangers 31 and the air handling side heat exchanger 41. Accordingly, the air handling unit 4 is situated upstream and each indoor unit 3 is situated downstream in the flow of the heat medium heated by the transfer of heat from the heat source side refrigerant cycle circuit A. In a case where the outside air is heated, the temperature of the heat medium may not need to be higher than in any of the indoor units 3, as dehumidifying is not performed. However, in the air handling unit 4, the outside air that exchange heat with the heat medium does not show an abrupt change in temperature. Further, the targeted space shows a small change in temperature, either. This makes it possible to stabilize the temperature of a heat medium that flows toward each indoor unit 3. For this reason, in a case where a heated heat medium is circulated through the heat medium cycle circuit B, as well as a case where a cooled heat medium is circulated through the heat medium cycle circuit B, it is preferable that the air handling unit 4 be situated upstream.

Figure 4:
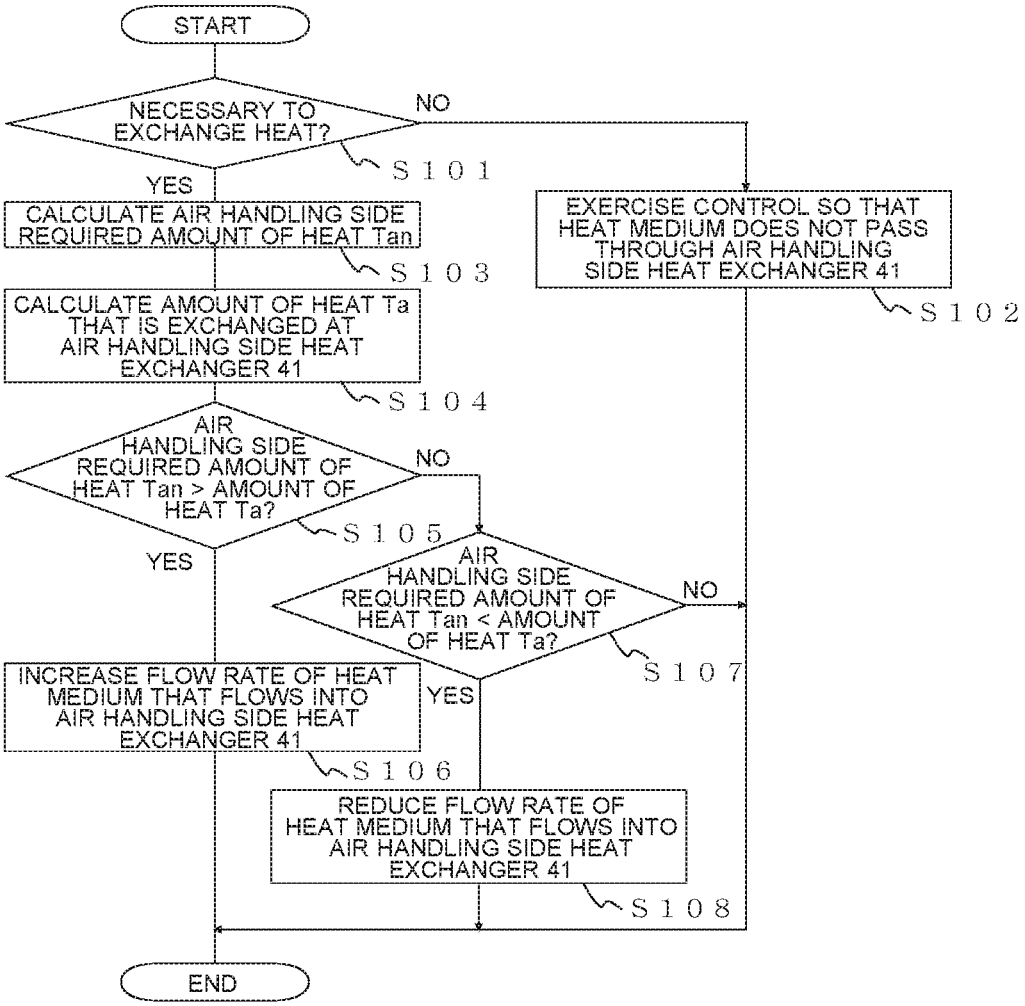
FIG. 4 is a flow chart of control that is exercised by an air handling unit control device 400 according to Embodiment 1 of the present disclosure.

Next, control that is exercised by the air handling unit control device 400 in Embodiment 1 is described. FIG. 4 is a flow chart of control that is exercised by the air handling unit control device 400 according to Embodiment 1 of the present disclosure.

First, in step S101, the air handling unit control device 400 determines whether it is necessary to exchange heat between the outside air and the heat medium. For example, in a case where the air handling unit 4 is performing an operation, such as cooling or dehumidifying a room, of cooling the outside air, the air handling unit control device 400 determines, if the outside air temperature is higher than the air handling side set temperature, that it is necessary to exchange heat or determines, if the outside air temperature is not higher than the air handling side set temperature, that it is not necessary to exchange heat. Further, in a case where the air handling unit 4 is performing an operation, such as heating a room, of heating the outside air, the air handling unit control device 400 determines, if the outside air temperature is lower than the air handling side set temperature, that it is necessary to exchange heat or determines, if the outside air temperature is not lower than the air handling side set temperature, that it is not necessary to exchange heat. The temperature detected by the outside air temperature sensor 532 is used as the temperature of the outside air for making the determination.

In a case where the air handling unit control device 400 has determined that it is not necessary to exchange heat (NO in step S101), the air handling unit control device 400 proceeds to step S102. In step S102, the air handling unit control device 400 exercises control so that the heat medium does not pass through the air handling side heat exchanger 41. Specifically, the air handling unit control device 400 exercises control so that the air handling side flow rate control device 42 is fully closed. Then, after having finished step S102, the air handling unit control device 400 ends the control process shown in FIG. 4.

In a case where the air handling unit control device 400 has determined that it is necessary to exchange heat (YES in step S101), the air handling unit control device 400 proceeds to steps S103 and S104. In step S103, the air handling unit control device 400 calculates an air handling side required amount of heat Tan. The air handling side required amount of heat Tan is an amount of heat required for the outside air temperature to reach the air handling side set temperature. For example, in a case where the air handling unit 4 is performing an operation of cooling the outside air, the air handling side required amount of heat Tan is an amount of cooling required to cool the outside air to the air handling side set temperature, and in a case where the air handling unit 4 is performing an operation of heating the outside air, the air handling side required amount of heat Tan is an amount of heating required to heat the outside air to the air handling side set temperature. The air handling side required amount of heat Tan is calculated on the basis of the difference between the outside air temperature and the air handling side set temperature. When the difference between the outside air temperature and the air handling side set temperature decreases, the air handling side required amount of heat Tan decreases. When the difference between the outside air temperature and the air handling side set temperature increases, the air handling side required amount of heat Tan increases.

Furthermore, in step S104, the air handling unit control device 400 calculates an amount of heat Ta that is exchanged at the air handling side heat exchanger 41. As the heat medium does not involve a change of phase in the air handling side heat exchanger 41, the amount of heat Ta that is exchanged at the air handling side heat exchanger 41 can be calculated on the basis of the temperature difference between the temperature of the heat medium that flows into the air handling side heat exchanger 41 and the temperature of the heat medium that flows out from the air handling side heat exchanger 41 and the flow rate of a heat medium that passes through the air handling side heat exchanger 41. Further, the flow rate of the heat medium that passes through the air handling side heat exchanger 41 can be calculated on the basis of the differential pressure between the pressure of the heat medium that flows into the air handling side heat exchanger 41 and the pressure of the heat medium that flows out from the air handling side heat exchanger 41 and the Cv value of the air handling side flow rate control device 42. The Cv value is a coefficient for calculating the flow rate of a fluid that passes through a valve at a predetermined differential pressure, and, as long as the valve is the same and the heat medium is the same, the Cv value is determined by the opening degree of the valve. Accordingly, the air handling unit control device 400 calculates, on the basis of the temperature detected by the air handling inlet side temperature sensor 515, the temperature detected by the air handling outlet side temperature sensor 516, the pressure detected by the air handling inlet side pressure sensor 523, the pressure detected by the air handling outlet side pressure sensor 524, and the opening degree of the air handling side flow rate control device 42, the amount of heat Ta that is exchanged at the air handling side heat exchanger 41.

After having finished steps S103 and S104, the air handling unit control device 400 proceeds to step S105. In step S105, the air handling unit control device 400 determines whether the air handling side required amount of heat Tan calculated in step S103 is larger than the amount of heat Ta calculated in step S104.

In a case where the air handling unit control device 400 has determined, in step S105, that the air handling side required amount of heat Tan calculated in step S103 is larger than the amount of heat Ta calculated in step S104 (YES in step S105), the air handling unit control device 400 proceeds to step S106. In step S106, the air handling unit control device 400 exercises control so that the flow rate of the heat medium that flows into the air handling side heat exchanger 41 becomes higher than the flow rate in step S104. A specific example is a method for exercising control so that the opening degree of the air handling side flow rate control device 42 becomes larger than the opening degree used to calculate the amount of heat Ta that is exchanged at the air handling side heat exchanger 41 as of step S104, a method for exercising control so that the opening degree of the bypass side flow rate control device 45 becomes smaller than the opening degree in step S104, or a combination of these two methods. After having finished step S106, the air handling unit control device 400 ends the control process shown in FIG. 4.

In a case where the air handling unit control device 400 has determined, in step S105, that the air handling side required amount of heat Tan calculated in step S103 is not larger than the amount of heat Ta calculated in step S104 (NO in step S105), the air handling unit control device 400 proceeds to step S107. In step S107, the air handling unit control device 400 determines whether the air handling side required amount of heat Tan calculated in step S103 is smaller than the amount of heat Ta calculated in step S104.

In a case where the air handling unit control device 400 has determined, in step S107, that the air handling side required amount of heat Tan calculated in step S103 is smaller than the amount of heat Ta calculated in step S104 (YES in step S107), the air handling unit control device 400 proceeds to step S108. In step S108, the air handling unit control device 400 exercises control so that the flow rate of the heat medium that flows into the air handling side heat exchanger 41 becomes lower than the flow rate as of step S104. A specific example is a method for exercising control so that the opening degree of the air handling side flow rate control device 42 becomes smaller than the opening degree used to calculate the amount of heat Ta that is exchanged at the air handling side heat exchanger 41 as of step S104, a method for exercising control so that the opening degree of the bypass side flow rate control device 45 becomes larger than the opening degree in step S104, or a combination of these two methods. After having finished step S108, the air handling unit control device 400 ends the control process shown in FIG. 4.

A case where the air handling unit control device 400 has determined, in step S107, that the air handling side required amount of heat Tan calculated in step S103 is not smaller than the amount of heat Ta calculated in step S104 (NO in step S107) is a case where the air handling side required amount of heat Tan calculated in step S103 is equal to the amount of heat Ta calculated in step S104. Accordingly, the air handling unit control device 400 ends the control process shown in FIG. 4 without changing the opening degree of the air handling side flow rate control device 42.

In the flow chart of FIG. 4, an increase in the difference between the outside air temperature and the air handling side set temperature leads to an increase in the flow rate of a heat medium that flows through the air handling side heat exchanger 41. This is because the flow rate of the heat medium that flows through the air handling side heat exchanger 41 increases in step S106, as an increase in the difference between the outside air temperature and the air handling side set temperature leads to an increase in the air handling side required amount of heat Tan and, by extension, to a wider range of amounts of heat Ta that satisfy the condition of step S105.

Figure 5:
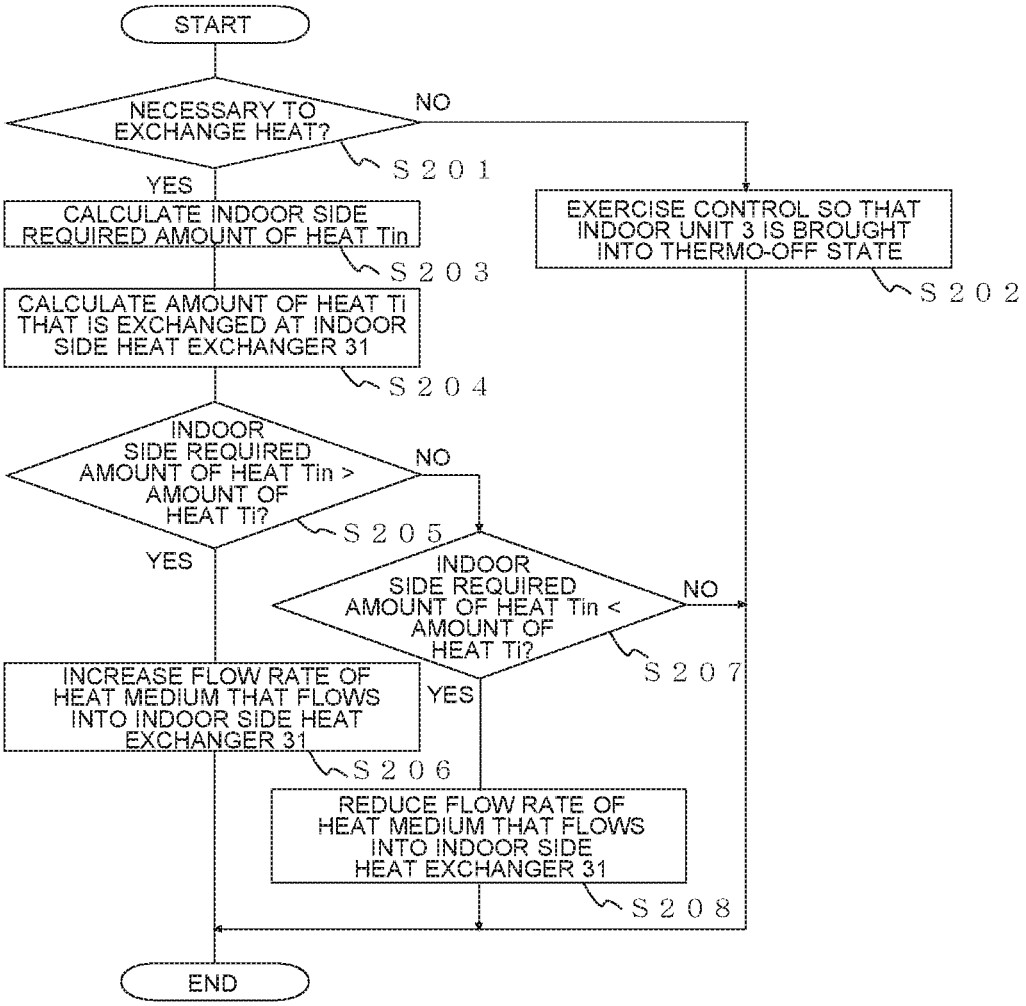
FIG. 5 is a flow chart of control that is exercised by an indoor unit control device 300 according to Embodiment 1 of the present disclosure.

Next, control that is exercised by the indoor unit control device 300 in Embodiment 1 is described. FIG. 5 is a flow chart of control that is exercised by the indoor unit control device 300 according to Embodiment 1 of the present disclosure.

First, in step S201, the indoor unit control device 300 determines whether it is necessary to exchange heat between the indoor air and the heat medium. For example, in a case where the indoor unit 3 is performing an operation, such as cooling or dehumidifying a room, of cooling the indoor air, the indoor unit control device 300 determines, if the temperature of the indoor air is higher than an indoor side set temperature, that it is necessary to exchange heat or determines, if the temperature of the indoor air is not higher than the indoor side set temperature, that it is not necessary to exchange heat. Further, in a case where the indoor unit 3 is performing an operation, such as heating a room, of heating the indoor air, the indoor unit control device 300 determines, if the temperature of the indoor air is lower than the indoor side set temperature, that it is necessary to exchange heat or determines, if the temperature of the indoor air is not lower than the indoor side set temperature, that it is not necessary to exchange heat. The temperature detected by the indoor temperature sensor 531 is used as the temperature of the indoor air for making the determination.

In a case where the indoor unit control device 300 has determined that it is not necessary to exchange heat (NO in step S201), the indoor unit control device 300 proceeds to step S202. In step S202, the indoor unit control device 300 exercises control so that the indoor unit 3 is brought into a thermo-off state. The thermo-off state is a state where the heat medium and the indoor air do not exchange heat in the indoor side heat exchanger 31, and an example of the thermo-off state is a state where the heat medium does not pass through the indoor side heat exchanger 31 with the indoor side flow rate control device 32 fully closed or a state where the indoor air is not sent to the indoor side heat exchanger 31 with the indoor side fan 33 stopped. After having finished step S202, the indoor unit control device 300 ends the control process shown in FIG. 5.

In a case where the indoor unit control device 300 has determined that it is necessary to exchange heat (YES in step S201), the indoor unit control device 300 proceeds to steps S203 and S204. In step S203, the indoor unit control device 300 calculates an indoor side required amount of heat Tin. The indoor side required amount of heat Tin is an amount of heat required for the indoor unit 3 to cause the indoor air to reach the indoor side set temperature. For example, in a case where the indoor unit 3 is performing an operation of cooling the indoor air, the indoor side required amount of heat Tin is an amount of cooling required to cool the indoor air to the indoor side set temperature, and in a case where the indoor unit 3 is performing an operation of heating the indoor air, the indoor side required amount of heat Tin is an amount of heating required to heat the indoor air to the indoor side set temperature. The indoor side required amount of heat Tin is calculated on the basis of the difference between the temperature of the indoor air and the indoor side set temperature. When the difference between the temperature of the indoor air and the indoor side set temperature decreases, the indoor side required amount of heat Tin decreases. When the difference between the temperature of the indoor air and the indoor side set temperature increases, the indoor side required amount of heat Tin increases.

Furthermore, in step S204, the indoor unit control device 300 calculates an amount of heat Ti that is exchanged at the indoor side heat exchanger 31. As the heat medium does not involve a change of phase in the indoor side heat exchanger 31, the amount of heat Ti that is exchanged at the indoor side heat exchanger 31 can be calculated on the basis of the temperature difference between the temperature of the heat medium that flows into the indoor side heat exchanger 31 and the temperature of the heat medium that flows out from the indoor side heat exchanger 31 and the flow rate of a heat medium that passes through the indoor side heat exchanger 31. Further, the flow rate of the heat medium that passes through the indoor side heat exchanger 31 can be calculated on the basis of the differential pressure between the pressure of the heat medium that flows into the indoor side heat exchanger 31 and the pressure of the heat medium that flows out from the indoor side heat exchanger 31 and the Cv value of the indoor side flow rate control device 32. That is, the indoor unit control device 300 calculates, on the basis of the temperature detected by the indoor inlet side temperature sensor 513, the temperature detected by the indoor outlet side temperature sensor 514, the pressure detected by the indoor inlet side pressure sensor 521, the pressure detected by the indoor outlet side pressure sensor 522, and the opening degree of the indoor side flow rate control device 32, the amount of heat Ti that is exchanged at the indoor side heat exchanger 31.

After having finished steps S203 and S204, the indoor unit control device 300 proceeds to step S205. In step S205, the indoor unit control device 300 determines whether the indoor side required amount of heat Tin calculated in step S203 is larger than the amount of heat Ti calculated in step S204.

In a case where the indoor unit control device 300 has determined, in step S205, that the indoor side required amount of heat Tin calculated in step S203 is larger than the amount of heat Ti calculated in step S204 (YES in step S205), the indoor unit control device 300 proceeds to step S206. In step S206, the indoor unit control device 300 exercises control so that the flow rate of the heat medium that flows into the indoor side heat exchanger 31 becomes higher than the flow rate as of step S204. Specifically, the indoor unit control device 300 exercises control so that the opening degree of the indoor side flow rate control device 32 becomes larger than the opening degree as of step S204. After having finished step S206, the indoor unit control device 300 ends the control process shown in FIG. 5.

In a case where the indoor unit control device 300 has determined, in step S205, that the indoor side required amount of heat Tin calculated in step S203 is not larger than the amount of heat Ti calculated in step S204 (NO in step S205), the indoor unit control device 300 proceeds to step S207. In step S207, the indoor unit control device 300 determines whether the indoor side required amount of heat Tin calculated in step S203 is smaller than the amount of heat Ti calculated in step S204.

In a case where the indoor unit control device 300 has determined, in step S207, that the indoor side required amount of heat Tin calculated in step S203 is smaller than the amount of heat Ti calculated in step S204 (YES in step S207), the indoor unit control device 300 proceeds to step S208. In step S208, the indoor unit control device 300 exercises control so that the flow rate of the heat medium that flows into the indoor side heat exchanger 31 becomes lower than the flow rate as of step S204. Specifically, the indoor unit control device 300 exercises control so that the opening degree of the indoor side flow rate control device 32 becomes smaller than the opening degree as of step S204. After having finished step S208, the indoor unit control device 300 ends the control process shown in FIG. 5.

A case where the indoor unit control device 300 has determined, in step S207, that the indoor side required amount of heat Tin calculated in step S203 is not smaller than the amount of heat Ti calculated in step S204 (NO in step S207) is a case where the indoor side required amount of heat Tin calculated in step S203 is equal to the amount of heat Ti calculated in step S204. Accordingly, the indoor unit control device 300 ends the control process shown in FIG. 5 without changing the opening degree of the indoor side flow rate control device 32.

In a case where the air-conditioning apparatus 0 includes a plurality of the indoor units 3, the control of the flow chart of FIG. 5 is executed by each indoor unit 3. That is, in the air-conditioning apparatus 0 according to Embodiment 1, the control of the flow chart of FIG. 5 is executed by the indoor unit control device 300 of each of the indoor units 3*a*, 3*b*, and 3*c*.

Figure 6:
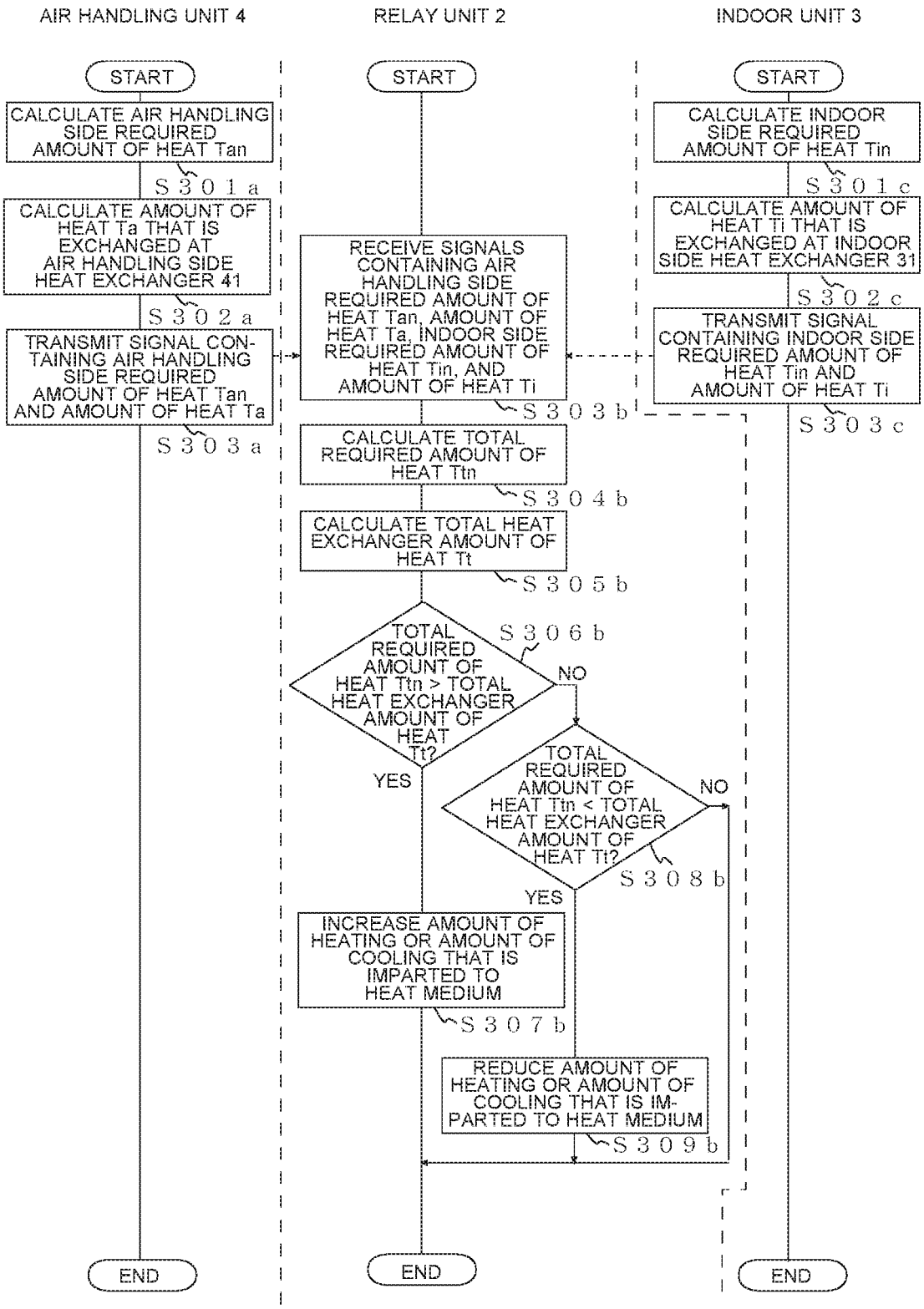
FIG. 6 is a flow chart of cooperative control of the air-conditioning apparatus 0 according to Embodiment 1 of the present disclosure.

Next, cooperative control of the outdoor unit 1, the relay unit 2, each of the indoor units 3, and the air handling unit 4 is described. FIG. 6 is a flow chart of cooperative control of the air-conditioning apparatus 0 according to Embodiment 1 of the present disclosure.

First, in step S301*a*, the air handling unit control device 400 calculates an air handling side required amount of heat Tan. The air handling side required amount of heat Tan may be calculated by the same method as that used in step S103 and may be the same value as that calculated in step S103.

In step S302*a*, the air handling unit control device 400 calculates an amount of heat Ta of the air handling side heat exchanger 41. The amount of heat Ta that is exchanged at the air handling side heat exchanger 41 may be calculated by the same method as that used in step S104 and may be the same value as that calculated in step S104.

After having finished steps S301*a* and S302*a*, the air handling unit control device 400 proceeds to step S303*a*. In step S303*a*, the air handling unit control device 400 transmits, to the relay unit control device 200, a signal containing data pertaining to the air handling side required amount of heat Tan calculated in step S301*a* and data pertaining to the amount of heat Ta, calculated in step S302*a*, that is exchanged at the air handling side heat exchanger 41. After having finished step S303*a*, the air handling unit control device 400 ends the cooperative control process shown in FIG. 6.

Further, in step S301*c*, the indoor unit control device 300 calculates an indoor side required amount of heat Tin. The indoor side required amount of heat Tin may be calculated by the same method as that used in step S203 and may be the same value as that calculated in step S203.

In step S302*c*, the indoor unit control device 300 calculates an amount of heat Ti that is exchanged at the indoor side heat exchanger 31. The amount of heat Ti that is exchanged at the indoor side heat exchanger 31 may be calculated by the same method as that used in step S204 and may be the same value as that calculated in step S204.

After having finished steps S301*c* and S302*c*, the indoor unit control device 300 proceeds to step S303*c*. In step S303*c*, the indoor unit control device 300 transmits, to the relay unit control device 200, a signal containing data pertaining to the indoor side required amount of heat Tin calculated in step S301*c* and data pertaining to the amount of heat Ti, calculated in step S302*c*, that is exchanged at the indoor side heat exchanger 31. After having finished step S303*c*, the indoor unit control device 300 ends the cooperative control process shown in FIG. 6.

The process from step S301*c* to step S303*c* in FIG. 6 is executed by each of the indoor unit control devices 300*a*, 300*b*, and 300*c*. That is, the indoor unit control devices 300*a*, 300*b*, and 300*c* calculate indoor side required amounts of heat Tina, Tinb, and Tinc required by the indoor units 3*a*, 3*b*, and 3*c*, amounts of heat Tia, Tib and Tic that are exchanged at the indoor side heat exchangers 31*a*, 31*b*, and 31*c*, respectively, and transmit signals containing the data thus calculated to the relay unit control device 200.

In step S303*b*, the relay unit control device 200 receives the signal transmitted from the air handling unit control device 400 in step S303*a* and the signals transmitted from the respective indoor unit control devices 300 in step S303*c*. That is, the relay unit control device 200 obtains the data pertaining to the air handling side required amount of heat Tan, the data pertaining to the amount of heat Ta that is exchanged at the air handling side heat exchanger 41, the data pertaining to the indoor side required amounts of heat Tina, Tinb, and Tinc of the indoor units 3*a*, 3*b*, and 3*c* and the data pertaining to the amounts of heat Tia, Tib, and Tic that are exchanged at the indoor side heat exchangers 31*a*, 31*b*, and 31*c*.

After having received the signals from the air handling unit control device 400 and the indoor unit control devices 300*a*, 300*b*, and 300*c*, to all of which the relay unit control device 200 is communicably connected, in step S303*b*, the relay unit control device 200 proceeds to steps S304*b* and S305*b*.

In step S304*b*, the relay unit control device 200 calculates a total required amount of heat Ttn on the basis of the signals received in step S303*b*. The total required amount of heat Ttn is the sum of the air handling side required amount of heat Tan calculated by the air handling unit control device 400 communicably connected to the relay unit control device 200 and the indoor side required amounts of heat Tin calculated by the indoor unit control devices 300 communicably connected to the relay unit control device 200. That is, in Embodiment 1, the total required amount of heat Ttn is the sum of the air handling side required amount of heat Tan calculated by the air handling unit control device 400, the indoor side required amount of heat Tina calculated by the indoor unit control device 300*a*, the indoor side required amount of heat Tinb calculated by the indoor unit control device 300*b*, and the indoor side required amount of heat Tinc calculated by the indoor unit control device 300*c*.

In step S305*b*, the relay unit control device 200 calculates a total heat exchanger amount of heat Tt on the basis of the signals received in step S303*b*. The total heat exchanger amount of heat Tt is the sum of the amount of heat, calculated by the air handling unit control device 400 communicably connected to the relay unit control device 200, that is exchanged at the air handling side heat exchanger 41 and the amounts of heat, calculated by the indoor unit control devices 300 communicably connected to the relay unit control device 200, that are exchanged at the indoor side heat exchangers 31. That is, in Embodiment 1, the total heat exchanger amount of heat Tt is the sum of the amount of heat Ta, calculated by the air handling unit control device 400, that is exchanged in the air handling side heat exchanger 41, the amount of heat Tia, calculated by the indoor unit control device 300*a*, that is exchanged at the indoor side heat exchanger 31*a*, the amount of heat Tib, calculated by the indoor unit control device 300*b*, that is exchanged at the indoor side heat exchanger 31*b*, and the amount of heat Tic, calculated by the indoor unit control device 300*c*, that is exchanged at the indoor side heat exchanger 31*c*.

After having finished steps S304*b* and S305*b*, the relay unit control device 200 proceeds to step S306*b*. In step S306*b*, the relay unit control device 200 determines whether the total required amount of heat Ttn calculated in step S304*b* is larger than the total heat exchanger amount of heat Tt calculated in step S305*b*.

In a case where the relay unit control device 200 has determined that the total required amount of heat Ttn calculated in step S304*b* is larger than the total heat exchanger amount of heat Tt calculated in step S305*b* (YES in step S306*b*), the relay unit control device 200 proceeds to step S307*b*. In step S307*b*, the relay unit control device 200 exercises control to increase an amount of heating or an amount of cooling that is imparted to the heat medium in the heat medium heat exchanger 21. An example of the method for increasing the amount of heating or the amount of cooling that is imparted to the heat medium is a method for increasing the rotation frequency of the pump 22 or a method for increasing the rotation frequency of the compressor 10 by sending a signal to the outdoor unit control device 100. After having finished step S307*b*, the relay unit control device 200 ends the cooperative control process shown in FIG. 6.

In a case where the relay unit control device 200 has determined that the total required amount of heat Ttn calculated in step S304*b* is not larger than the total heat exchanger amount of heat Tt calculated in step S305*b* (NO in step S306*b*), the relay unit control device 200 proceeds to step S308*b*. In step S308*b*, the relay unit control device 200 determines whether the total required amount of heat Ttn calculated in step S304*b* is smaller than the total heat exchanger amount of heat Tt calculated in step S305*b*.

In a case where the relay unit control device 200 has determined that the total required amount of heat calculated in step S304*b* is smaller than the total heat exchanger amount of heat calculated in step S305*b* (YES in step S308*b*), the relay unit control device 200 proceeds to step S309*b*. In step S309*b*, the relay unit control device 200 exercises control to reduce the amount of heating or the amount of cooling that is imparted to the heat medium in the heat medium heat exchanger 21. As opposed to step S307*b*, an example of the method for reducing the amount of heating or the amount of cooling that is imparted to the heat medium is a method for reducing the rotation frequency of the pump 22 or a method for reducing the rotation frequency of the compressor 10 by sending a signal to the outdoor unit control device 100. After having finished step S309*b*, the relay unit control device 200 ends the cooperative control process shown in FIG. 6.

A case where the relay unit control device 200 has determined that the total required amount of heat calculated in step S304*b* is not smaller than the total heat exchanger amount of heat calculated in step S305*b* (NO in step S308*b*) is a case where the total required amount of heat calculated in step S304*b* is equal to the total heat exchanger amount of heat calculated in step S305*b*. For this reason, the relay unit control device 200 ends the cooperative control process shown in FIG. 6 without changing the amount of heating or the amount of cooling that is imparted to the heat medium in the heat medium heat exchanger 21.

As noted above, with the air-conditioning apparatus 0 of Embodiment 1, in the heat medium cycle circuit B, the air handling unit 4 is situated upstream and each indoor unit 3 is situated downstream in the flow of the heat medium heated or cooled by the heat medium heat exchanger 21 when the heat medium heat exchanger 21 is defined as a starting point of the flow of the heat medium. Note here that in an environment in which the indoor air and the outside air are cooled, the outside air is often warmer and wetter than the indoor air. Accordingly, while the indoor units 3 cool heat generated in a room such as heat generated from a human body or a piece of equipment, the air handling unit 4 needs to cool and dehumidify the outside air. That is, whereas the indoor units 3 perform only sensible heat processing, the air handling unit 4 performs both sensible heat processing and latent heat processing and requires a larger amount of heat than do the indoor units 3. Accordingly, as the air-conditioning apparatus 0 of Embodiment 1 causes the heat medium subjected to heat exchange by the heat medium heat exchanger 21 to pass through the air handling unit 4 first and to then flow into the indoor units 3, the heat medium is supplied to the air handling unit 4, which requires a large amount of heat first, so that the air handling unit 4 hardly lacks a sufficient amount of heat. This makes it possible to efficiently perform heat supply. This is effective especially in a case where the air handling unit 4 dehumidifies a room and the indoor units 3 cool rooms.

Further, the air-conditioning apparatus 0 of Embodiment 1 includes the air handling side flow rate control device 42, which adjusts the flow rate of the heat medium that passes through the air handling side heat exchanger 41. Accordingly, the amount of heat that is exchanged at the air handling side heat exchanger 41 is adjusted by adjusting the flow rate of the heat medium, so that heat supply can be efficiently performed. In particular, the operation of adjusting the flow rate of a heat medium with a heat medium flow control device such as the air handling side flow rate control device 42 saves more energy than the adjustment of the amount of heating or the amount of cooling of the heat medium by the heat source side unit (namely, the outdoor unit 1 and the relay unit 2). This makes it possible to more efficiently perform heat supply.

Further, the air-conditioning apparatus 0 of Embodiment 1 controls, depending on the amount of heat that is exchanged in the air handling side heat exchanger 41 and an amount of heat required by the air handling side heat exchanger 41, the flow rate of the heat medium that passes through the air handling side heat exchanger 41.

Accordingly, when the difference between the outside air temperature and the air handling side set temperature increases, control is exercised depending on an amount of heat detected by the air handling side amount-of-heat detection device and the amount of heat required by the air handling side heat exchanger 41 so that the flow rate of the heat medium that passes through the air handling side heat exchanger 41 increases. This makes it possible to efficiently perform heat supply.

Further, in the air-conditioning apparatus 0 of Embodiment 1, the outdoor unit control device 100, the relay unit control device 200, the indoor unit control devices 300, and the air handling unit control device 400 can communicate signals containing various types of data to and from one another. For example, the pieces of equipment of the air-conditioning apparatus 0 can exercise cooperative control such as the changing of the capacity of the internal pump by the relay unit control device 200 on the basis of data collected by the indoor unit control devices 300. In particular, the heat source side unit (namely the outdoor unit 1 and the relay unit 2) can be controlled on the basis of the sum of the amounts of heat required by the indoor units 3 and the air handling unit 4, so that heat supply can be efficiently performed.

Further, in the air-conditioning apparatus 0 of Embodiment 1, each indoor unit 3 and the air handling unit 4 each include an amount-of-heat detection device that detects an amount of heat involved in heat exchange with a heat load, and can each communicate a signal containing data on the amount of heat involved in heat exchange. For this reason, in the air handling unit 4 and each indoor unit 3, an amount of heat that is imparted to the heat medium by the heat source side refrigerant that circulates through the heat source side refrigerant cycle circuit A can be controlled depending on the sum of amounts of heat that the heat medium exchanges, so that energy saving can be achieved. In particular, in Embodiment 1, the air handling unit 4 includes an amount-of-heat detection device. In the air-conditioning apparatus 0 of Embodiment 1, a heat medium heated or cooled by the heat medium heat exchanger 21 passes through the air handling unit 4 earlier than any of the indoor units 3. For this reason, the air handling unit 4 hardly lacks a sufficient amount of heat even if the amount of heat is unknown because of the absence of an amount-of-heat detection device. However, by the air handling unit 4 including an amount-of-heat detection device and obtaining an amount of heat that is supplied in the air handling unit 4, the heat medium cycle circuit B can accurately obtain the sum of amounts of heat that the heat medium exchanges, so that further energy saving can be achieved.

It is desirable that the control that is exercised by the air handling unit control device 400 as shown in the flow chart of FIG. 4, the control that is exercised by the indoor unit control device 300 as shown in the flow chart of FIG. 5, and the cooperative control of the air-conditioning apparatus 0 as shown in the flow chart of FIG. 6 be each cyclically exercised in a case where the air-conditioning apparatus 0 is operating. The cycle at which the control shown in each flow chart is exercised may be freely determined by a designer or a user. Note, however, that as, the changing of the opening degree of the air handling side flow rate control device 42 or the indoor side flow rate control device 32 usually requires a smaller amount of electricity than does the changing of the rotation frequency of the compressor 10 or the pump 22, the temperature of the outside air or the indoor air can be adjusted in a more energy-saving manner by changing the opening degree of the air handling side flow rate control device 42 or the indoor side flow rate control device 32 first and then by changing the rotation frequency of the compressor 10 or the pump 22. Accordingly, it is desirable that the cycle at which the flow rate of the heat medium that passes through the air handling side heat exchanger 41 or the indoor side heat exchangers 31 is controlled as shown in FIG. 4 or 5 be shorter than the cycle at which the amount of heat that is exchanged between the heat source side refrigerant and the heat medium is controlled as shown in FIG. 6.

Further, although, in Embodiment 1 of the present disclosure, the air handling side amount-of-heat detection device includes the air handling unit control device 400, the air handling inlet side temperature sensor 515, the air handling outlet side temperature sensor 516, the air handling inlet side pressure sensor 523, and the air handling outlet side pressure sensor 524, this is not intended to impose any limitation. For example, the air handling inlet side pressure sensor 523 and the air handling outlet side pressure sensor 524 may be replaced by a flow rate sensor that measures the flow rate of the heat medium that passes through the air handling side heat exchanger 41, and on the basis of the temperature difference between the temperature of the heat medium that flows into the air handling side heat exchanger 41 and the temperature of the heat medium that flows out from the air handling side heat exchanger 41 and the flow rate measured by the flow rate sensor, the amount of heat Ta that is exchanged at the air handling side heat exchanger 41 may be calculated by the air handling unit control device 400. In this case, the air handling unit control device 400, the air handling inlet side temperature sensor 515, the air handling outlet side temperature sensor 516, and the flow rate sensor correspond to the air handling side amount-of-heat detection device. Alternatively, amount-of-heat sensors that directly measure amounts of heat of heat media may be provided to inflow and outflow ports of the air handling side heat exchanger 41, and on the basis of the difference between the amount of heat detected by the amount-of-heat sensor provided to the inflow port and the amount of heat detected by the amount-of-heat sensor provided to the outflow port, the amount of heat Ta that is exchanged at the air handling side heat exchanger 41 may be calculated by the air handling unit control device 400. In this case, the air handling unit control device 400 and the amount-of-heat sensors correspond to the air handling side amount-of-heat detection device. Note, however, that as the flow rate sensor and the amount-of-heat sensors are more expensive than the pressure sensors and the temperature sensors, the cost is lower in the case where the amount of heat to be exchanged is calculated on the basis of the pressure sensors and the temperature sensors than the case where the flow rate sensor and the amount-of-heat sensors are used.

Furthermore, the amount of heat Ti that is exchanged at the indoor side heat exchanger 31 may be calculated in the same manner as the amount of heat Ta that is exchanged at the air handling side heat exchanger 41. That is, a flow rate sensor may be provided that measures the flow rate of the heat medium that passes through the indoor side heat exchanger 31, and on the basis of the temperature difference between the temperature of the heat medium that flows into the indoor side heat exchanger 31 and the temperature of the heat medium that flows out from the indoor side heat exchanger 31 and the flow rate measured by the flow rate sensor, the amount of heat Ti that is exchanged at the indoor side heat exchanger 31 may be calculated. Alternatively, sensors that directly measure amounts of heat of heat media may be provided to inflow and outflow ports of the indoor side heat exchanger 31, and on the basis of the difference between the amount of heat detected by the sensor provided to the inflow port and the amount of heat detected by the sensor provided to the outflow port, the amount of heat Ti that is exchanged at the indoor side heat exchanger 31 may be calculated.

Embodiment 2

Figure 7:
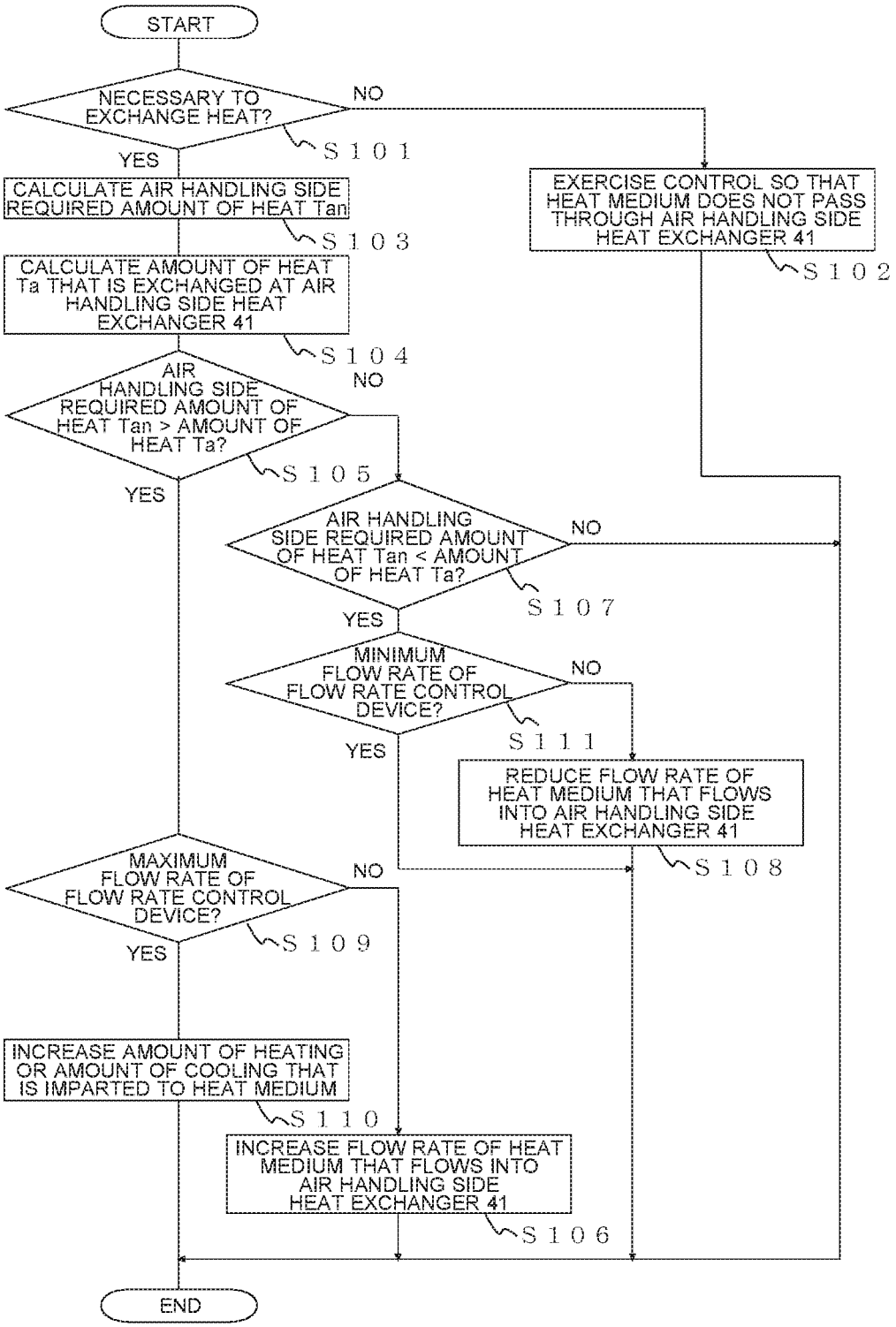
FIG. 7 is a flow chart of control that is exercised by an air handling unit control device 400 according to Embodiment 2 of the present disclosure.

FIG. 7 is a flow chart of control that is exercised by an air handling unit control device 400 according to Embodiment 2 of the present disclosure. Embodiment 2 differs from Embodiment 1 only in a flow chart of control that is exercised by the air handling unit control device 400, and the configuration of the air-conditioning apparatus 0, the control of the indoor unit control device 300, and the cooperative control of the control devices are the same as those of Embodiment 1 and are thus not described below.

As in the case of Embodiment 1, in step S101, the air handling unit control device 400 determines whether it is necessary to exchange heat between the outside air and the heat medium. In a case where the air handling unit control device 400 has determined that it is not necessary to exchange heat (NO in step S101), the air handling unit control device 400 proceeds to step S102, in which the air handling unit control device 400 exercises control so that the heat medium does not pass through the air handling side heat exchanger 41. Then, the air handling unit control device 400 ends the control process shown in FIG. 7.

In a case where the air handling unit control device 400 has determined that it is necessary to exchange heat (YES in step S101), the air handling unit control device 400 proceeds to steps S103 and S104. As in the case of Embodiment 1, the air handling unit control device 400 calculates the air handling side required amount of heat Tan in step S103 and calculates the amount of heat Ta of the air handling side heat exchanger 41 in step S104.

After finishing steps S103 and S104, the air handling unit control device 400 proceeds to step S105. In step S105, the air handling unit control device 400 determines whether the air handling side required amount of heat Tan calculated in step S103 is larger than the amount of heat Ta calculated in step S104.

In a case where the air handling unit control device 400 has determined, in step S105, that the air handling side required amount of heat Tan calculated in step S103 is larger than the amount of heat Ta calculated in step S104 (YES in step S105), the air handling unit control device 400 proceeds to step S109. In step S109, the air handling unit control device 400 determines whether the flow rate of the heat medium that flows into the air handling side heat exchanger 41 as of step S104 is a maximum flow rate that can be adjusted solely by the air handling unit control device 400. A specific example is a state where the opening degree of the air handling side flow rate control device 42 is at its maximum, a state where the opening degree of the bypass side flow rate control device 45 is at its minimum, or a state where the opening degree of the air handling side flow rate control device 42 is at its maximum and the opening degree of the bypass side flow rate control device 45 is at its minimum.

In a case where the air handling unit control device 400 has determined, in step S109, that the flow rate of the heat medium that flows into the air handling side heat exchanger 41 is the maximum flow rate that can be adjusted solely by the air handling unit control device 400 (YES in step S109), the air handling unit control device 400 proceeds to step S110. In step S110, the air handling unit control device 400 transmits, to the relay unit control device 200, a signal that requests the relay unit control device 200 to increase the amount of heating or the amount of cooling that is imparted to the heat medium in the heat medium heat exchanger 21. When the relay unit control device 200 receives the signal, the relay unit control device 200 exercises control to increase the amount of heating or the amount of cooling that is imparted to the heat medium by the heat source side unit, as in the case of step S304*b* of Embodiment 1. After having finished step S110, the air handling unit control device 400 ends the control process shown in FIG. 7.

In a case where the air handling unit control device 400 has determined, in step S109, that the flow rate of the heat medium that flows into the air handling side heat exchanger 41 is not the maximum flow rate that can be adjusted solely by the air handling unit control device 400 (NO in step S109), the air handling unit control device 400 proceeds to step S106, in which the air handling unit control device 400 exercises control so that the flow rate of the heat medium that flows into the air handling side heat exchanger 41 becomes higher than the flow rate in step S104, as in the case of Embodiment 1. After having finished step S106, the air handling unit control device 400 ends the control process shown in FIG. 7.

In a case where the air handling unit control device 400 has determined, in step S105, that the air handling side required amount of heat Tan calculated in step S103 is not larger than the amount of heat Ta calculated in step S104 (NO in step S105), the air handling unit control device 400 proceeds to step S107. In step S107, the air handling unit control device 400 determines whether the air handling side required amount of heat Tan calculated in step S103 is smaller than the amount of heat Ta calculated in step S104.

In a case where the air handling unit control device 400 has determined, in step S107, that the air handling side required amount of heat Tan calculated in step S103 is smaller than the amount of heat Ta calculated in step S104 (YES in step S107), the air handling unit control device 400 proceeds to step S111. In step S111, the air handling unit control device 400 determines whether the flow rate of the heat medium that flows into the air handling side heat exchanger 41 as of step S104 is a minimum flow rate that can be adjusted solely by the air handling unit control device 400. A specific example is a state where the opening degree of the air handling side flow rate control device 42 is at its minimum, a state where the opening degree of the bypass side flow rate control device 45 is at its maximum, or a state where the opening degree of the air handling side flow rate control device 42 is at its minimum and the opening degree of the bypass side flow rate control device 45 is at its maximum.

In a case where the air handling unit control device 400 has determined, in step S111, that the flow rate of the heat medium that flows into the air handling side heat exchanger 41 is the minimum flow rate that can be adjusted solely by the air handling unit control device 400 (YES in step S111), the air handling unit control device 400 ends the control process shown in FIG. 7 without changing the opening degree of the air handling side flow rate control device 42, as the flow rate of the heat medium that flows into the air handling side heat exchanger 41 cannot be reduced by the air handling side flow rate control device 42.

In a case where the air handling unit control device 400 has determined, in step S111, that the flow rate of the heat medium that flows into the air handling side heat exchanger 41 is not the minimum flow rate that can be adjusted solely by the air handling unit control device 400 (NO in step S111), the air handling unit control device 400 proceeds to step S108, in which the air handling unit control device 400 exercises control so that the flow rate of the heat medium that flows into the air handling side heat exchanger 41 becomes lower than the flow rate in step S104, as in the case of Embodiment 1. After having finished step S108, the air handling unit control device 400 ends the control process shown in FIG. 7.

In a case where the air handling unit control device 400 has determined, in step S107, that the air handling side required amount of heat Tan calculated in step S103 is not smaller than the amount of heat Ta calculated in step S104 (NO in step S107), the air handling unit control device 400 ends the control process shown in FIG. 7 without changing the opening degree of the air handling side flow rate control device 42.

The heat medium having flowed out from the heat medium heat exchanger 21 flows into the air handling unit 4 first. Accordingly, in a case where the amount of heat required by the air handling side heat exchanger 41 has not been reached even with the maximum flow rate that can be controlled solely by the air handling unit control device 400, the amount of heat required by the air handling side heat exchanger 41 is not reached unless the amount of heat that is conveyed to the air handling unit 4 is increased. The air-conditioning apparatus 0 according to Embodiment 2 is configured in such a manner that in a case where the amount of heat required by the air handling side heat exchanger 41 has not been reached even with the maximum flow rate that can be controlled solely by the air handling unit control device 400, the air handling unit control device 400 transmits, to the relay unit control device 200, a signal that requests the relay unit control device 200 to exercise control to increase the amount of heat that is exchanged between the refrigerant and the heat medium in the heat medium heat exchanger 21. This configuration makes it possible to more surely reach the amount of heat required by the air handling side heat exchanger 41.

Embodiment 3

Figure 8:
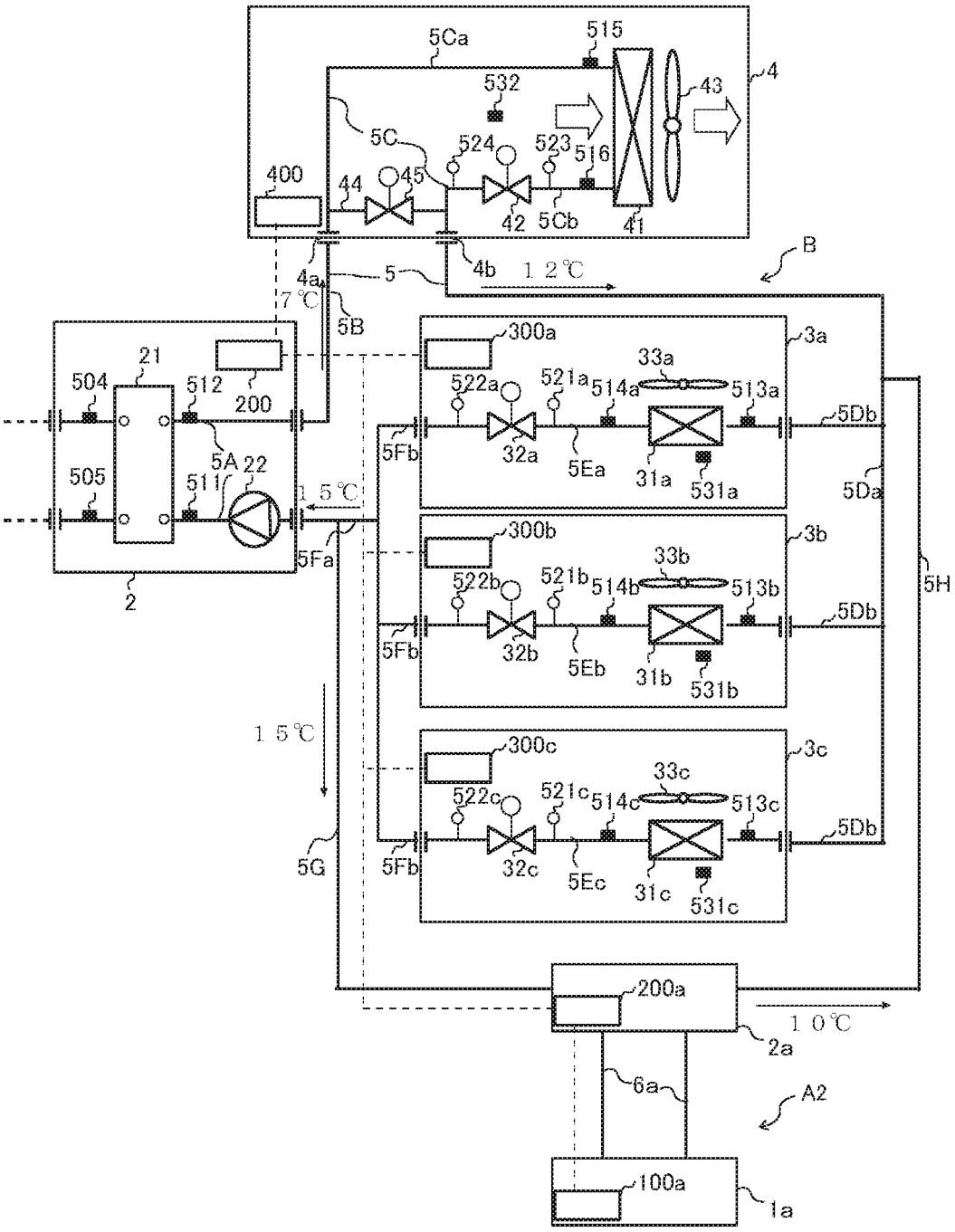
FIG. 8 is a diagram showing an example of a configuration of an air-conditioning apparatus 0 according to Embodiment 3 of the present disclosure.

FIG. 8 is a diagram showing an example of a configuration of an air-conditioning apparatus 0 according to Embodiment 3 of the present disclosure. In FIG. 8, the pieces of equipment or other devices given the same reference signs as those of FIGS. 1 to 3 perform the same operations as those of Embodiment 1. Further, indoor units 3 of Embodiment 3 exercise the control of the flow chart of FIG. 5 of Embodiment 1, and an air handling unit 4 of Embodiment 3 exercises the control of the flow chart of FIG. 4 of Embodiment 1 or the control of the flow chart of FIG. 7 of Embodiment 2. In addition to the components described in Embodiment 1, the air-conditioning apparatus 0 of Embodiment 3 includes an auxiliary outdoor unit 1*a* and an auxiliary relay unit 2*a*.

The auxiliary outdoor unit 1*a* and the auxiliary relay unit 2*a* are similar in internal equipment configuration to the outdoor unit 1 and the relay unit 2 described in Embodiment 1, respectively, and are connected to each other by a refrigerant pipe 6*a*. Accordingly, the auxiliary outdoor unit 1*a* and the auxiliary relay unit 2*a* form an auxiliary heat source side refrigerant cycle circuit A2 that is similar in structure to the heat source side refrigerant cycle circuit A1, with auxiliary heat source side refrigerant flowing through the auxiliary heat source side refrigerant cycle circuit A2. Note here that in a case where the heat source side refrigerant is flowing through the heat source side refrigerant cycle circuit A1 to cool the heat medium, the auxiliary heat source side refrigerant flows through the auxiliary heat source side refrigerant cycle circuit A2 to cool the heat medium, too, and that in a case where the heat source side refrigerant is flowing through the heat source side refrigerant cycle circuit A1 to heat the heat medium, the auxiliary heat source side refrigerant flows through the auxiliary heat source side refrigerant cycle circuit A2 to heat the heat medium, too. It should be noted that the auxiliary outdoor unit 1*a* and the auxiliary relay unit 2*a* correspond to an auxiliary heat source side unit of the present disclosure.

Further, as is the case with the outdoor unit 1, the auxiliary outdoor unit 1*a* includes an auxiliary outdoor unit control device 100*a* that exercises at least control of the capacity of a compressor in the auxiliary outdoor unit 1*a*. Furthermore, as is the case with the relay unit 2, the auxiliary relay unit 2*a* includes an auxiliary relay unit control device 200*a* that exercises at least control of the capacity of a pump in the auxiliary relay unit 2*a*. The auxiliary outdoor unit control device 100*a* and the auxiliary relay unit control device 200*a* are each communicably connected to at least the relay unit control device 200 by radio or by cable and can communicate signals containing various types of data to and from the relay unit control device 200.

In the air-conditioning apparatus 0 of Embodiment 3, the heat medium cycle circuit B is provided with a fourth connecting pipe 5G and a fifth connecting pipe 5H. The fourth connecting pipe 5G connects the main pipe 5Fa of the third connecting pipe 5F with the auxiliary relay unit 2*a*, and the air-conditioning apparatus 0 is configured in such a manner that a portion of heat media having converged after flowing out from the indoor units 3*a* to 3*c* flows into the auxiliary relay unit 2*a*. The fifth connecting pipe 5H connects the auxiliary relay unit 2*a* with the main pipe 5Da of the second connecting pipe 5D, and the air-conditioning apparatus 0 is configured in such a manner that the heat medium having flowed out from the auxiliary relay unit 2*a* flows into the indoor units 3*a* to 3*c* via the second connecting pipe 5D. Accordingly, the auxiliary relay unit 2*a* heats or cools portions of the heat media having flowed out from the indoor units 3*a* to 3*c* by causing the portions of the heat media to exchange heat with the auxiliary heat source side refrigerant flowing through the auxiliary heat source side refrigerant cycle circuit A2, and the portions of the heat media thus heated or cooled flow into the indoor units 3 after converging at the main pipe 5Da with the heat medium having flowed out from the air handling unit 4.

Note here that an amount of cooling or an amount of heating that is imparted from the auxiliary relay unit 2*a* is controlled so that in a case where the heat medium is cooled in the relay unit 2, the temperature of the heat medium that passes through the auxiliary relay unit 2*a* becomes lower than the temperature of a heat medium having flowed out from the air handling unit 4 and so that in a case where the heat medium is heated in the relay unit 2, the temperature of the heat medium that passes through the auxiliary relay unit 2*a* becomes higher than the temperature of the heat medium having flowed out from the air handling unit 4. Accordingly, the auxiliary relay unit 2*a* raises or lowers the temperature of the heat medium having flowed out from the air handling unit 4.

Figure 9:
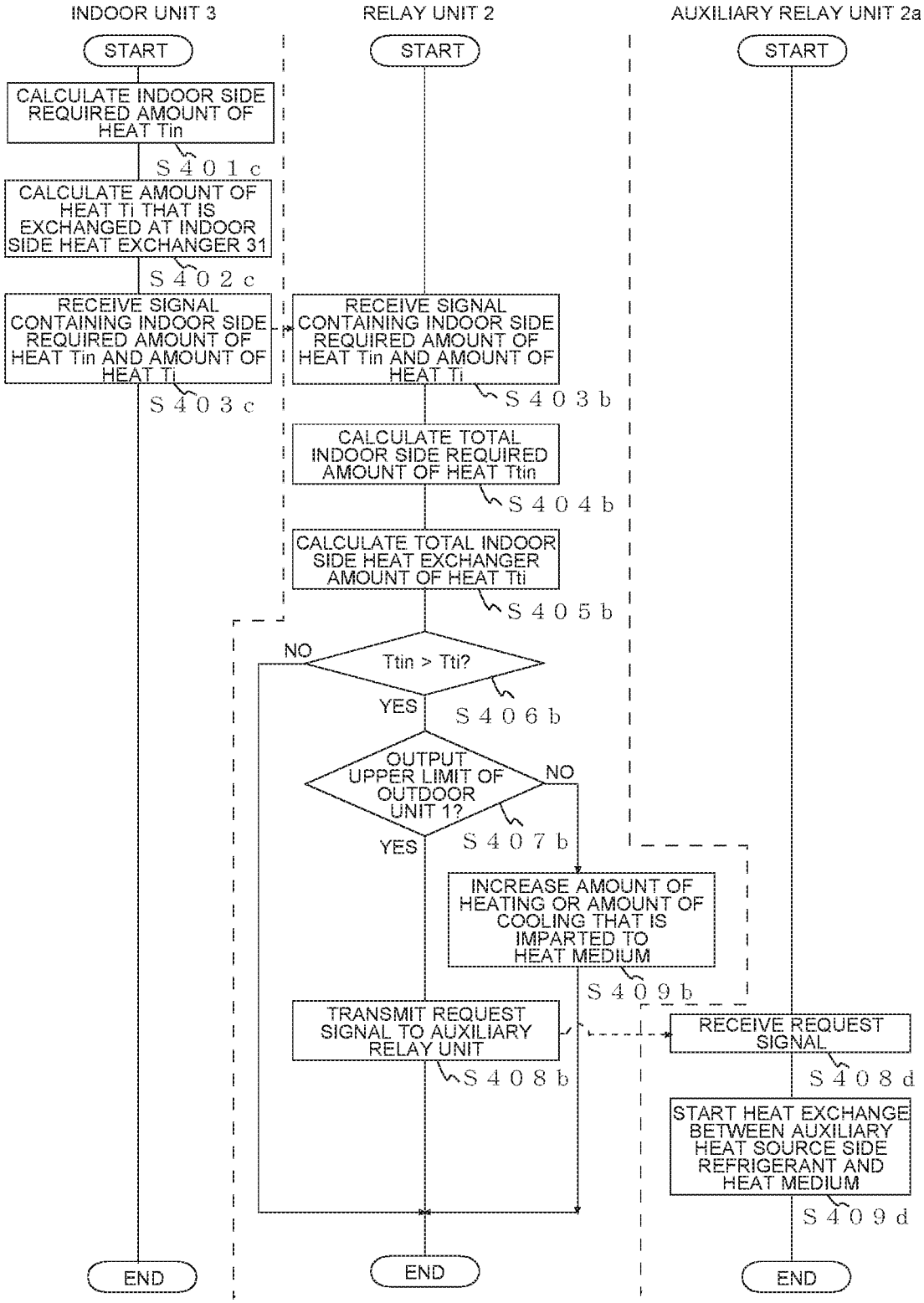
FIG. 9 is a flow chart of cooperative control of the air-conditioning apparatus 0 according to Embodiment 3 of the present disclosure.

Next, cooperative control that is exercised by the outdoor unit 1, the relay unit 2, each of the indoor units 3, the auxiliary outdoor unit 1*a*, and the auxiliary relay unit 2*a* according to Embodiment 3 is described. FIG. 9 is a flow chart of cooperative control of the air-conditioning apparatus 0 according to Embodiment 3 of the present disclosure. At the start of the flow chart of FIG. 9, the auxiliary heat source side refrigerant cycle circuit A2 is defined to be not heating or cooling the heat medium.

In step S401*c*, the indoor unit control device 300 calculates an indoor side required amount of heat Tin. The indoor side required amount of heat Tin may be calculated by the same method as that used in step S203 and may be the same value as that calculated in step S203.

In step S402*c*, the indoor unit control device 300 calculates an amount of heat Ti that is exchanged at the indoor side heat exchanger 31. The amount of heat Ti that is exchanged at the indoor side heat exchanger 31 may be calculated by the same method as that used in step S204 and may be the same value as that calculated in step S204.

After having finished steps S401*c* and S402*c*, the indoor unit control device 300 proceeds to step S403*c*. In step S403*c*, the indoor unit control device 300 transmits, to the relay unit control device 200, a signal containing data pertaining to the indoor side required amount of heat Tin calculated in step S401*c* and data pertaining to the amount of heat Ti, calculated in step S402*c*, that is exchanged at the indoor side heat exchanger 31. After having finished step S403*c*, the indoor unit control device 300 ends the cooperative control process shown in FIG. 9.

The process from step S401*c* to step S403*c* in FIG. 9 is executed by each of the indoor unit control devices 300*a*, 300*b*, and 300*c*. That is, the indoor unit control devices 300*a*, 300*b*, and 300*c* calculate indoor side required amounts of heat Tina, Tinb, and Tinc required by the indoor units 3*a*, 3*b*, and 3*c*, amounts of heat Tia, Tib and Tic that are exchanged at the indoor side heat exchangers 31*a*, 31*b*, and 31*c*, respectively, and transmit signals containing the data thus calculated to the relay unit control device 200.

In step S403*b*, the relay unit control device 200 receives the signals transmitted from the respective indoor unit control devices 300 in step S403*c*. That is, the relay unit control device 200 obtains the data pertaining to the indoor side required amounts of heat Tina, Tinb, and Tinc of the indoor units 3*a*, 3*b*, and 3*c* and the data pertaining to the amounts of heat Tia, Tib, and Tic that are exchanged at the indoor side heat exchangers 31*a*, 31*b*, and 31*c*.

After having received the signals from the indoor unit control devices 300*a*, 300*b*, and 300*c*, to all of which the relay unit control device 200 is communicably connected, in step S403*b*, the relay unit control device 200 proceeds to steps S404*b* and S405*b*.

In step S404*b*, the relay unit control device 200 calculates a total indoor side required amount of heat Ttin on the basis of the signals received in step S403*b*. The total indoor side required amount of heat Ttin is the sum of the indoor side required amounts of heat Tin calculated by the indoor unit control devices 300 communicably connected to the relay unit control device 200. That is, in Embodiment 3, the total indoor side required amount of heat Ttin is the sum of the indoor side required amount of heat Tina calculated by the indoor unit control device 300*a*, the indoor side required amount of heat Tinb calculated by the indoor unit control device 300*b*, and the indoor side required amount of heat Tinc calculated by the indoor unit control device 300*c*.

In step S405*b*, the relay unit control device 200 calculates a total indoor side heat exchanger amount of heat Tti on the basis of the signals received in step S403*b*. The total indoor side heat exchanger amount of heat Tti is the sum of the amount of heat, calculated by the air handling unit control device 400 communicably connected to the relay unit control device 200, that is exchanged at the air handling side heat exchanger 41 and the amounts of heat, calculated by the indoor unit control devices 300 communicably connected to the relay unit control device 200, that are exchanged at the indoor side heat exchangers 31. That is, in Embodiment 3, the total indoor side heat exchanger amount of heat Tti is the sum of the amount of heat Ta, calculated by the air handling unit control device 400, that is exchanged at the air handling side heat exchanger 41, the amount of heat Tia, calculated by the indoor unit control device 300*a*, that is exchanged at the indoor side heat exchanger 31*a*, the amount of heat Tib, calculated by the indoor unit control device 300*b*, that is exchanged at the indoor side heat exchanger 31*b*, and the amount of heat Tic, calculated by the indoor unit control device 300*c*, that is exchanged at the indoor side heat exchanger 31*c*.

After having finished steps S404*b* and S405*b*, the relay unit control device 200 proceeds to step S406*b*. In step S406*b*, the relay unit control device 200 determines whether the total indoor side required amount of heat Ttni calculated in step S404*b* is larger than the total indoor side heat exchanger amount of heat Tti calculated in step S405*b*. In a case where the relay unit control device 200 has determined that the total indoor side required amount of heat Ttni calculated in step S404*b* is not larger than the total indoor side heat exchanger amount of heat Tti calculated in step S405*b* (NO in step S406*b*), the relay unit control device 200 ends the cooperative control process shown in FIG. 9.

In a case where the relay unit control device 200 has determined that the total indoor side required amount of heat Ttni calculated in step S404*b* is larger than the total indoor side heat exchanger amount of heat Tti calculated in step S405*b* (YES in step S406*b*), the amounts of heat that are exchanged at the indoor side heat exchangers 31 are insufficient and the relay unit control device 200 proceeds to step S407*b*. In step S407*b*, the relay unit control device 200 determines whether the heat source side unit (namely the outdoor unit 1 and the relay unit 2) has reached a predetermined output upper limit. For example, in a state where the compressor 10 has reached a predetermined upper limit capacity, a state where the pump 202 has reached a predetermined upper limit capacity, a state where the temperature detected by the heat medium outlet side temperature sensor 512 is lower than a lower limit heat medium temperature set in advance at a higher temperature than the freezing point of the heat medium in a case where the heat medium is cooled by the heat medium heat exchanger 21, or a state where the temperature detected by the heat medium outlet side temperature sensor 512 is higher than a higher limit heat medium temperature set in advance at a lower temperature than the boiling point of the heat medium in a case where the heat medium is heated by the heat medium heat exchanger 21, the relay unit control device 200 determines that the heat source side unit has reached the output upper limit.

In a case where the relay unit control device 200 has determined that the heat source side unit has reached the output upper limit (YES in step S407*b*), the relay unit control device 200 proceeds to step S408*b*. In step S408*b*, the relay unit control device 200 transmits, to the auxiliary relay unit control device 200*a* of the auxiliary relay unit 2*a*, a signal that requests the auxiliary relay unit control device 200*a* to start operation of the auxiliary heat source side unit. After having finished step S408*b*, the relay unit control device 200 ends the cooperative control process shown in FIG. 9.

In step S408*d*, the auxiliary relay unit control device 200*a* receives the signal transmitted from the relay unit control device 200 in step S408*b*. After having received the signal in step S408*d*, the auxiliary relay unit control device 200*a* proceeds to step S409*d*, in which the auxiliary relay unit control device 200*a* starts the heating or cooling of the heat medium by the auxiliary heat source side refrigerant cycle circuit A2. After having finished step S409*d*, the auxiliary relay unit control device 200*a* ends the cooperative control process shown in FIG. 9.

In a case where the relay unit control device 200 has determined that the heat source side unit has not reached the output upper limit (NO in step S407*b*), the relay unit control device 200 proceeds to step S409*b*, in which the relay unit control device 200 exercises control to increase the amount of heat that is exchanged between the refrigerant and the heat medium in the heat medium heat exchanger 21, as in the case of step S307*b* of FIG. 6. After having finished step S409*b*, the relay unit control device 200 ends the cooperative control process shown in FIG. 9.

A compressor and a pump usually have upper limit values to their capacities to prevent damage. Further, a frozen or vaporized heat medium may damage a pipe or a heat exchanger. Accordingly, to prevent damage to the compressor 10, the pump 22, the pipes, and the heat exchangers, the heat source side refrigerant cycle circuit A has an upper limit to the amount of heat that is exchanged between the heat source side refrigerant and the heat medium. For this reason, for example, an increase in the amount of heat that is consumed by heat exchange with the outside air in the air handling unit 4 leads to a possibility that the amount of heat required to exchange heat with the indoor air in each indoor unit 3 may not be sufficiently provided even when an upper limit to the amount of heat that is exchanged between the heat source side refrigerant and the heat medium is reached.

To address this problem, the air-conditioning apparatus 0 of Embodiment 3 starts the heating or cooling of the heat medium by the auxiliary heat source side refrigerant cycle circuit A2 in a state where the heat source side unit has reached the output upper limit and the amounts of heat that are exchanged at the indoor side heat exchangers 31 are insufficient. The auxiliary heat source side refrigerant cycle circuit A2 makes it possible to make up for the shortfalls in the amounts of heat. This thus makes it possible to more surely perform air conditioning of the indoor spaces.

It is desirable that the cooperative control of the air-conditioning apparatus 0 as shown in the flow chart of FIG. 9 be cyclically exercised in a case where the air-conditioning apparatus 0 is operating. The cycle at which the cooperative control in the flow chart of FIG. 9 is exercised may be freely determined by a designer or a user.

Note, however, that the start of the heating or cooling of the heat medium by the auxiliary heat source side refrigerant cycle circuit A2 leads to an increase in energy consumption volume. Accordingly, it is desirable that the cycle at which the amount of heat that is exchanged between the heat source side refrigerant and the heat medium is controlled as shown in FIG. 6 or the cycle at which the flow rate of the heat medium that passes through the air handling side heat exchanger 41 or the indoor side heat exchangers 31 is controlled as shown in FIG. 4 or 5 be shorter than the cycle at which the control for activating the auxiliary heat source side unit is exercised as shown in FIG. 9.

Embodiment 4

Figure 10:
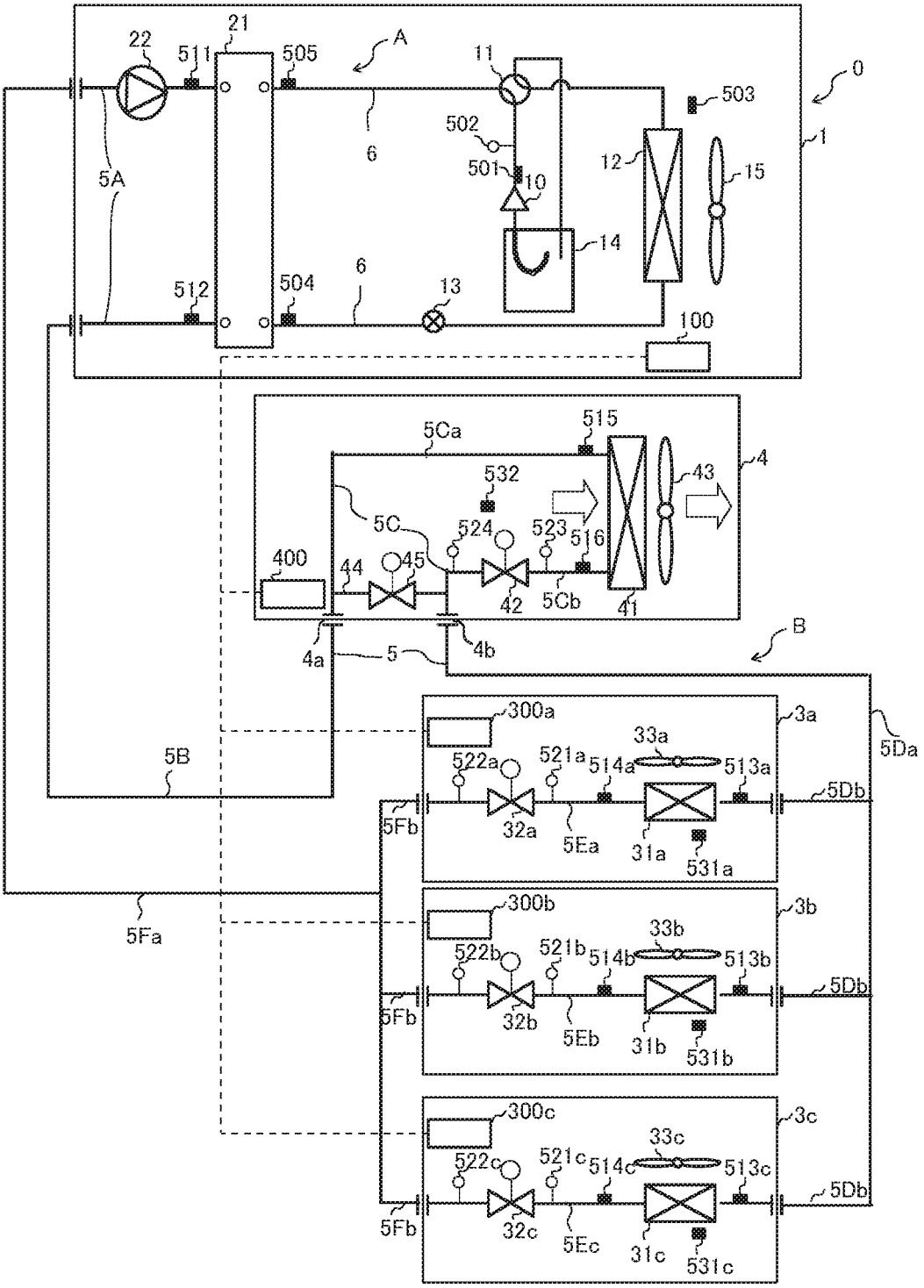
FIG. 10 is a diagram showing a configuration of an air-conditioning apparatus 0 according to Embodiment 4 of the present disclosure.

FIG. 10 is a diagram showing a configuration of an air-conditioning apparatus 0 according to Embodiment 4 of the present disclosure. In FIG. 10, the pieces of equipment or other devices given the same reference signs as those of FIG. 2 perform the same operations as those of the air-conditioning apparatus 0 of any of Embodiments 1 to 3. The air-conditioning apparatus 0 according to Embodiment 4 is one obtained by integrating the pieces of equipment in the relay unit 2 described in each of Embodiments 1 to 3 into the outdoor unit 1. For this reason, in the air-conditioning apparatus 0 according to Embodiment 4, the outdoor unit 1, the air handling unit 4, and each indoor unit 3 are connected by piping through the heat medium pipe 5. This makes it possible to exercise the control or other actions described Embodiments 1 and 2 without providing the relay unit 2, which is separate.

In Embodiment 4, the outdoor unit 1 corresponds to the heat source side unit of the present disclosure. Further, the outdoor unit control device 100 is used as both the outdoor unit control device 100 and the relay unit control device 200 according to any of Embodiments 1 to 3. Accordingly, the control exercised by the relay unit control device 200 in the control of FIGS. 6 and 9 is exercised by the outdoor unit control device 100.

The same applies to the auxiliary outdoor unit 1*a* and the auxiliary relay unit 2*a* according to Embodiment 3. That is, the pieces of equipment in the auxiliary relay unit 2*a* may be integrated into the auxiliary outdoor unit 1*a*.

Modifications of Embodiments 1 to 4 In each of Embodiments 1 to 4 described above, the air handling unit 4 includes the air handling side flow rate control device 42. Further, each indoor unit 3 includes the indoor side flow rate control device 32. Alternatively, these flow rate control devices may be incorporated into another independent unit.

Further, although, in each of Embodiments 1 to 4 described above, the heat medium is heated or cooled by using the outdoor unit 1 and the relay unit 2 as the heat source side unit, forming the heat source side refrigerant cycle circuit A through which the heat source side refrigerant circulates, and causing the heat medium heat exchanger 21 to be used as an evaporator or a condenser, this is not intended to impose any limitation. Examples of other configurations may include a configuration in which the heat medium is only heated by the heat medium exchanger used solely as an evaporator and a configuration in which the heat medium is only cooled by the heat medium exchanger used solely as a condenser, without a refrigerant flow switching device provided in the heat source side refrigerant cycle circuit. Further, the heat source side unit may have a configuration other than the configuration that includes the heat source side refrigerant cycle circuit and may be configured in any manner as long as it is configured to heat or cool the heat medium. Examples of such configurations include a configuration in which the heat medium is heated by an electric heater or the heat of combustion of gas and a configuration in which the heat medium is cooled by ice.

Further, although, in the flow chart of FIG. 6, the relay unit control device 200 calculates the total required amount of heat Ttn (step S304*b*), calculates the total heat exchanger amount of heat Tt (step S305*b*), and compares the total required amount of heat Ttn with the total heat exchanger amount of heat Tt (steps S306*b* and S308*b*), these steps may be executed by another control device. For example, the outdoor unit control device 100 may receive the data pertaining to the air handling side required amount of heat Tan, the amount of heat Ta that is exchanged at the air handling side heat exchanger 41, the indoor side required amounts of heat Tin, and the amounts of heat Ti that are exchanged at the indoor side heat exchangers 31 (step S303*b*), calculate the total required amount of heat Ttn (step S304*b*), calculate the total heat exchanger amount of heat Tt (step S305*b*), compare the total required amount of heat Ttn with the total heat exchanger amount of heat Tt (steps S306*b* and S308*b*), and increase or decrease, on the basis of a result of the comparison, the amount of heat that is exchanged between the heat source side refrigerant and the heat medium (steps S307*b* and S309*b*). Further, similarly, although, in the flow chart of FIG. 9, the relay unit control device 200 determines whether the total indoor side required amount of heat Ttin can be attained solely by the heat source side unit (step S406*b*) and requests the auxiliary heat source side unit to perform an operation (step S408*b*) and the auxiliary relay unit control device 200*a* starts the heat exchange of the heat medium by the auxiliary heat source side unit (step S409*d*), these steps may be executed by another control device.

As shown in Embodiments 1 to 4 and their modifications, an aspect directed to a first air-conditioning apparatus 0 that attains the object of the present application includes a heat source side unit that heats or cools a heat medium used as a heat-conveying medium, an air handling side heat exchanger 41 that exchanges heat between outside air that is sent into a building and the heat medium, and an indoor side heat exchanger 31 that exchanges heat between indoor air and the heat medium. The heat source side unit, the air handling side heat exchanger 41, and the indoor side heat exchanger 31 are connected by piping to each other to form a heat medium cycle circuit B through which the heat medium circulates. In the heat medium cycle circuit B, a portion of the heat medium heated or cooled by the heat source side unit flows into the indoor side heat exchanger 31 after having passed through the air handling side heat exchanger 41. The heat medium cycle circuit B is provided with an air handling side flow rate control device 42 that adjusts a flow rate of the heat medium that passes through the air handling side heat exchanger 41.

With this configuration, the heat medium cycle circuit B is configured in such a manner that a portion of the heat medium heated or cooled by the heat source side unit flows into the indoor side heat exchanger 31 after having passed through the air handling side heat exchanger 41. This allows the heat medium to pass through the air handling side heat exchanger 41, in which there is only a small change in amount of heat that is consumed by a heat load, first and to then pass through the indoor side heat exchanger 31, and an effect of making it possible to efficiently perform heat supply is thus brought about. In particular, this configuration is more useful in a case where the air handling side heat exchanger 41 performs dehumidifying and the indoor side heat exchanger 31 performs cooling.

Furthermore, the aspect directed to the first air-conditioning apparatus 0 is configured in such a manner that the heat medium cycle circuit B is provided with an air handling side flow rate control device 42 that adjusts a flow rate of the heat medium that passes through the air handling side heat exchanger 41.

This configuration makes it possible to control the amount of heat that is conveyed to the air handling side heat exchanger 41, and an effect of making it possible to efficiently perform heat supply is thus brought about.

Further, in an aspect directed to a second air-conditioning apparatus 0, the aspect directed to the first air-conditioning apparatus 0 may be additionally configured in such a manner that another portion of the heat medium heated or cooled by the heat source side unit flows into the indoor side heat exchanger 31 without passing through the air handling side heat exchanger 41, and the air handling side flow rate control device 42 adjusts a ratio between a flow rate of the heat medium that flows into the indoor side heat exchanger 31 through the air handling side heat exchanger 41 and a flow rate of the heat medium that flows into the indoor side heat exchanger 31 without passing through the air handling side heat exchanger 41.

With this configuration, the heat medium that has not passed through the air handling side heat exchanger 41 flows into the indoor side heat exchanger 31, too. This makes it possible to supply a hot or cold heat medium to the indoor side heat exchanger 31. This thus makes it possible to perform more efficient heat supply than in a case where only the heat medium that has passed through the air handling side heat exchanger 41 flows into the indoor side heat exchanger 31.

Further, in an aspect directed to a third air-conditioning apparatus 0, the aspect directed to the second air-conditioning apparatus 0 may be additionally configured in such a manner that a portion of the heat medium heated or cooled by the heat source side unit that has passed through the air handling side heat exchanger 41 and another portion of the heat medium heated or cooled by the heat source side unit that does not pass through the air handling side heat exchanger 41 flow into the indoor side heat exchanger 31 after having converged at a pipe connecting the air handling side heat exchanger 41 with the indoor side heat exchanger 31.

With this configuration, the heat medium that has passed through the air handling side heat exchanger 41 and the heat medium that does not pass through the air handling side heat exchanger 41 flow into the indoor side heat exchanger 31 after having been mixed together. This makes it possible to simplify the structure of the indoor side heat exchanger 31.

Further, in an aspect directed to a fourth air-conditioning apparatus 0, any of the aspects directed to the first to third air-conditioning apparatuses 0 may be additionally configured in such a manner that the heat medium cycle circuit B includes a bypass pipe 44 by which a pipe connecting the heat source side unit with the air handling side heat exchanger 41 and a pipe connecting the air handling side heat exchanger 41 with the indoor side heat exchanger 31 are connected to each other, without connecting through the air handling side heat exchanger 41, and the air handling side flow rate control device 42 adjusts a ratio between a flow rate of the heat medium that flows into the indoor side heat exchanger 31 through the air handling side heat exchanger 41 and a flow rate of the heat medium that flows into the indoor side heat exchanger 31 through the bypass pipe 44.

With this configuration, the heat medium that has not passed through the air handling side heat exchanger 41 flows into the indoor side heat exchanger 31, too. This makes it possible to supply a hot or cold heat medium to the indoor side heat exchanger 31. This thus makes it possible to perform more efficient heat supply than in a case where only the heat medium that has passed through the air handling side heat exchanger 41 flows into the indoor side heat exchanger 31.

Further, in an aspect directed to a fifth air-conditioning apparatus 0, any of the aspects directed to the first to fourth air-conditioning apparatuses 0 may be additionally configured in such a manner that the heat source side unit includes a compressor that compresses heat source side refrigerant, a heat source side heat exchanger that exchanges heat between the heat source side refrigerant and air, an expansion device that decompresses the heat source side refrigerant, and a heat medium heat exchanger that exchanges heat between the heat source side refrigerant and the heat medium, and the compressor, the heat source side heat exchanger, the expansion device, and the heat medium heat exchanger are connected by piping to one another to form a heat source side refrigerant cycle circuit.

Further, in an aspect directed to a sixth air-conditioning apparatus 0, any of the aspects directed to the first to fifth air-conditioning apparatuses 0 may be additionally configured in such a manner that when a difference between a temperature of the outside air and a predetermined air handling side set temperature increases, the air handling side flow rate control device 42 increases a flow rate of the heat medium that flows through the air handling side heat exchanger 41.

This configuration makes it possible to control, on the basis of the outdoor temperature and the set temperature, the amount of heat that is exchanged at the air handling side heat exchanger 41. This thus makes it possible to perform more efficient heat supply.

Further, in an aspect directed to a seventh air-conditioning apparatus 0, any of the aspects directed to the first to sixth air-conditioning apparatuses 0 may be additionally configured in such a manner that the air handling side flow rate control device 42 adjusts, on the basis of an amount of heat that is exchanged in the air handling side heat exchanger 41 and an amount of heat required by the air handling side heat exchanger 41, a flow rate of the heat medium that flows through the air handling side heat exchanger 41.

This configuration makes it possible to adjust, on the basis of the amount of heat that is exchanged at the air handling side heat exchanger 41 and the amount of heat required by the air handling side heat exchanger 41, the flow rate of the heat medium that flows through the air handling side heat exchanger 41. This thus makes it possible to perform more efficient heat supply.

The aspect directed to the seventh air-conditioning apparatus 0 may be additionally configured in such a manner that in a case where the amount of heat required by the air handling side heat exchanger 41 is larger than the amount of heat that is exchanged in the air handling side heat exchanger 41, the air handling side flow rate control device 42 increases the flow rate of the heat medium that flows through the air handling side heat exchanger 41.

With this configuration, in a case where the amount of heat that is supplied to the air handling side heat exchanger 41 is insufficient, the flow rate of the heat medium that flows through the air handling side heat exchanger 41 is increased, so that the amount of heat that is supplied to the air handling side heat exchanger 41 can be increased. Furthermore, the aspect directed to the seventh air-conditioning apparatus 0 may be additionally configured in such a manner that in a case where the amount of heat required by the air handling side heat exchanger 41 is smaller than the amount of heat that is exchanged in the air handling side heat exchanger 41, the air handling side flow rate control device 42 reduces the flow rate of the heat medium that flows through the air handling side heat exchanger 41.

With this configuration, in a case where the amount of heat that is supplied to the air handling side heat exchanger 41 is excessive, the flow rate of the heat medium that flows through the air handling side heat exchanger 41 is reduced, so that the amount of heat that is supplied to the air handling side heat exchanger 41 can be reduced.

Further, in an aspect directed to an eighth air-conditioning apparatus 0, any of the aspects directed to the first to seventh air-conditioning apparatuses 0 may be additionally configured in such a manner that in a case where an amount of heat required by the air handling side heat exchanger 41 is larger than an amount of heat that is exchanged in the air handling side heat exchanger 41 and an upper limit of a flow rate that is adjustable by the air handling side flow rate control device 42 is reached, the heat source side unit increases an amount of heating or an amount of cooling that is imparted to the heat medium.

With this configuration, even in a case where the amount of heat required by the air handling side heat exchanger 41 cannot be attained by the adjustment of the flow rate by the air handling side flow rate control device 42, the heat source side unit increases the amount of heating or the amount of cooling that is imparted to the heat medium, so that the amount of heat required by the air handling side heat exchanger 41 can be more surely attained.

Further, in an aspect directed to a ninth air-conditioning apparatus 0, any of the aspects directed to the first to eighth air-conditioning apparatuses 0 may be additionally configured in such a manner that the heat source side unit changes, on the basis of a sum of an amount of heat that is exchanged in the air handling side heat exchanger 41 and an amount of heat that is exchanged in the indoor side heat exchanger 31, an amount of heating or an amount of cooling that is imparted to the heat medium.

This configuration allows the heat source side unit to adjust the amount of heating or the amount of cooling on the basis of the amounts of heat that are exchanged in the air handling side heat exchanger 41 and the indoor side heat exchanger 31. This makes it possible to perform more efficient heat supply.

The aspect directed to the ninth air-conditioning apparatus 0 may be additionally configured in such a manner that the heat source side unit increases the amount of heating or the amount of cooling in a case where the sum of the amount of heat required by the air handling side heat exchanger 41 and the amount of heat required by the indoor side heat exchanger 31 is larger than the sum of the amount of heat that is exchanged in the air handling side heat exchanger 41 and the amount of heat that is exchanged in the indoor side heat exchanger 31.

This configuration allows the heat source side unit to, in a case where the amounts of heat that are supplied to the air handling side heat exchanger 41 and the indoor side heat exchanger 31 are insufficient, increase the amount of heating or the amount of cooling of the heat medium to supply the amounts of heat required by the air handling side heat exchanger 41 and the indoor side heat exchanger 31.

The aspect directed to the ninth air-conditioning apparatus 0 may be additionally configured in such a manner that the heat source side unit reduces the amount of heating or the amount of cooling in a case where the sum of the amount of heat required by the air handling side heat exchanger 41 and the amount of heat required by the indoor side heat exchanger 31 is smaller than the sum of the amount of heat that is exchanged in the air handling side heat exchanger 41 and the amount of heat that is exchanged in the indoor side heat exchanger 31.

This configuration allows the heat source side unit to, in a case where the amounts of heat that are supplied to the air handling side heat exchanger 41 and the indoor side heat exchanger 31 are excessive, reduce the amount of heating or the amount of cooling of the heat medium to achieve energy saving.

Further, in an aspect directed to a tenth air-conditioning apparatus 0, any of the aspects directed to the seventh to ninth air-conditioning apparatuses 0 may be additionally configured to further include an air handling side amount-of-heat detection device that detects an amount of heat that is exchanged in the air handling side heat exchanger 41, and may be additionally configured in such a manner that the air handling side amount-of-heat detection device includes an air handling inlet side temperature sensor 515 that detects a temperature of the heat medium that flows into the air handling side heat exchanger 41, an air handling outlet side temperature sensor 516 that detects a temperature of the heat medium that flows out from the air handling side heat exchanger 41, and an air handling unit control device 400 that calculates, on the basis of the temperature detected by the air handling inlet side temperature sensor 515, the temperature detected by the air handling outlet side temperature sensor 516, and the flow rate of the heat medium that passes through the air handling side heat exchanger 41, an amount of heat that is exchanged in the air handling side heat exchanger 41.

This configuration makes it possible to more accurately calculate, on the basis of the temperature of the heat medium that flows into the air handling side heat exchanger 41, the temperature of the heat medium that flows out from the air handling side heat exchanger 41, and the flow rate of the heat medium that passes through the air handling side heat exchanger 41, the amount of heat that is exchanged in the air handling side heat exchanger 41.

Further, in an aspect directed to an eleventh air-conditioning apparatus 0, the aspect directed to the tenth air-conditioning apparatus 0 may be additionally configured in such a manner that the air handling side flow rate control device 42 is a valve whose opening degree is adjustable, the air handling side amount-of-heat detection device includes an air handling inlet side pressure sensor 523 that detects a pressure of the heat medium that flows into the air handling side heat exchanger 41, and an air handling outlet side pressure sensor 524 that detects a pressure of the heat medium that flows out from the air handling side heat exchanger 41, and the air handling unit control device 400 calculates, on the basis of a differential pressure between the pressure detected by the air handling inlet side pressure sensor 523 and the pressure detected by the air handling outlet side pressure sensor 524 and the opening degree of the air handling side flow rate control device 42, the flow rate of the heat medium that passes through the air handling side heat exchanger 41.

With this configuration, the flow rate of the heat medium that passes through the air handling side heat exchanger 41 is calculated on the basis of the differential pressure between the pressure at the inflow port and the pressure at the outflow port of the air handling side heat exchanger 41 and the opening degree of the air handling side flow rate control device 42. This makes it possible to calculate the flow rate with inexpensive pressure sensors without using an expensive flowmeter. This thus makes it possible to reduce the cost of the air-conditioning apparatus 0.

Further, in an aspect directed to a twelfth air-conditioning apparatus 0, any of the aspects directed to the first to eleventh air-conditioning apparatuses 0 may be additionally configured to further include an air handling unit housing that houses the air handling side flow rate control device 42, the air handling side heat exchanger 41, and an air handling unit control device 400 that controls the air handling side flow rate control device 42, and a heat source side unit control device that controls an amount of heating or an amount of cooling that the heat source side unit supplies to the heat medium, and may be additionally configured in such a manner that the air handling unit control device 400 and the heat source side unit control device have a communication connection with each other.

This configuration allows the air handling unit control device 400 and the heat source side unit control device to transmit and receive information to and from each other, and the air handling unit 4 and the heat source side unit are thus allowed to exercise cooperative control. Note here that an example of the cooperative control is the exercise of control by the heat source side unit control device of a piece of equipment mounted in the heat source side unit on the basis of information pertaining to the status of the air handling unit 4 or the exercise of control by the air handling unit control device 400 of a piece of equipment mounted in the air handling unit 4 on the basis of information pertaining to the status of the heat source side unit.

Further, in an aspect directed to a thirteenth air-conditioning apparatus 0, any of the aspects directed to the first to twelfth air-conditioning apparatuses 0 may be additionally configured to further include an auxiliary heat source side unit that raises or lowers a temperature of the heat medium that is to flow into the indoor side heat exchanger 31 after passing through the air handling side heat exchanger 41.

With this configuration, even in a state where the amount of heat that is exchanged at the indoor side heat exchanger 31 is insufficient, the auxiliary heat source side unit makes it possible to make up for the shortfall in the amount of heat. This thus makes it possible to more surely perform air conditioning of an indoor space.

Further, in an aspect directed to a fourteenth air-conditioning apparatus 0, the aspect directed to the thirteenth air-conditioning apparatus 0 may be additionally configured in such a manner that the auxiliary heat source side unit heats or cools the heat medium, and the heat medium that is to flow into the indoor side heat exchanger 31 after passing through the air handling side heat exchanger 41 flows into the indoor side heat exchanger 31 after converging with the heat medium heated or cooled by the auxiliary heat source side unit.

With this configuration, the heat medium that has passed through the air handling side heat exchanger 41 and the heat medium heated or cooled by the auxiliary heat source side unit flow into the indoor side heat exchanger 31 after having been mixed together. This makes it possible to simplify the structure of the indoor side heat exchanger 31.

Further, in an aspect directed to a fifteenth air-conditioning apparatus 0, the aspect directed to the fourteenth air-conditioning apparatus 0 may be additionally configured in such a manner that the auxiliary heat source side unit heats or cools the heat medium having flowed out from the indoor side heat exchanger 31, and the heat medium heated or cooled by the auxiliary heat source side unit does not pass through the heat source side unit and the air handling side heat exchanger 41 but converges with the heat medium having passed through the air handling side heat exchanger 41.

Further, in an aspect directed to a sixteenth air-conditioning apparatus 0, any of the aspects directed to the thirteenth to fifteenth air-conditioning apparatuses 0 may be additionally configured in such a manner that the auxiliary heat source side unit heats or cools the heat medium in a case where an amount of heat that is exchanged at the indoor side heat exchanger 31 is insufficient and the heat source side unit reaches a predetermined output upper limit.

With this configuration, even in a state where a sufficient amount of heat that is exchange by the indoor side heat exchanger 31 cannot be supplied solely by the heat source side unit, an amount of heat can be supplied by the auxiliary heat source side unit.

Furthermore, as shown in Embodiments 1 to 4 and their modifications, an aspect directed to a first air handling unit 4 that attains the object of the present application includes an air handling side heat exchanger 41 that exchanges heat between air that is sent from outside a targeted space into the targeted space and a portion of a heat medium heated or cooled by a heat source side unit, and an air handling side flow rate control device 42 that adjusts a flow rate of the heat medium that passes through the air handling side heat exchanger 41. The heat medium subjected to heat exchange by the air handling side heat exchanger 41 flows into an indoor side heat exchanger 31 that exchanges heat between indoor air and the heat medium.

This configuration makes it possible to adjust the flow rate of the heat medium that passes through the air handling side heat exchanger 41 and thereby control the amount of heat that is conveyed to the air handling side heat exchanger 41, and an effect of making it possible to efficiently perform heat supply is thus brought about.

Further, in an aspect directed to a second air handling unit 4, the aspect directed to the first air handling unit 4 may be additionally configured to further include an inlet 4*a* through which the heat medium heated or cooled by the heat source side unit flows in, an inward path pipe 5Ca connecting the inlet 4*a* with the air handling side heat exchanger 41, an outlet 4*b* through which the heat medium subjected to heat exchange by the air handling side heat exchanger 41 flows out, an outward path pipe 5Cb connecting the outlet 4*b* with the air handling side heat exchanger 41, and a bypass pipe 44 connecting the inward path pipe 5Ca with the outward path pipe 5Cb without connecting through the air handling side heat exchanger 41, and may be additionally configured in such a manner that the air handling side flow rate control device 42 adjusts a ratio between a flow rate of the heat medium that flows from the inlet 4*a* to the air handling side heat exchanger 41 and a flow rate of the heat medium that flows from the inlet 4*a* to the bypass pipe 44.

This configuration provides the air handling unit 4 with the bypass pipe 44. This thus makes installation easy, as a pipe connecting the heat source side unit with the air handling unit 4 does not need to be provided with the bypass pipe 44.

Further, in an aspect directed to a third air handling unit 4, the aspect directed to the first or second air handling unit 4 may be additionally configured in such a manner that the air handling side flow rate control device 42 adjusts, on the basis of an amount of heat that is exchanged in the air handling side heat exchanger 41 and an amount of heat required by the air handling side heat exchanger 41, a flow rate of the heat medium that flows through the air handling side heat exchanger 41.

This configuration makes it possible to adjust, on the basis of the amount of heat that is exchanged at the air handling side heat exchanger 41 and the amount of heat required by the air handling side heat exchanger 41, the flow rate of the heat medium that flows through the air handling side heat exchanger 41. This thus makes it possible to perform more efficient heat supply.

The aspect directed to the third air handling unit 4 may be additionally configured in such a manner that in a case where the amount of heat required by the air handling side heat exchanger 41 is larger than the amount of heat that is exchanged in the air handling side heat exchanger 41, the air handling side flow rate control device 42 increases the flow rate of the heat medium that flows through the air handling side heat exchanger 41.

With this configuration, in a case where the amount of heat that is supplied to the air handling side heat exchanger 41 is insufficient, the flow rate of the heat medium that flows through the air handling side heat exchanger 41 is increased, so that the amount of heat that is supplied to the air handling side heat exchanger 41 can be increased.

Furthermore, the aspect directed to the third air handling unit 4 may be additionally configured in such a manner that in a case where the amount of heat required by the air handling side heat exchanger 41 is smaller than the amount of heat that is exchanged in the air handling side heat exchanger 41, the air handling side flow rate control device 42 reduces the flow rate of the heat medium that flows through the air handling side heat exchanger 41.

With this configuration, in a case where the amount of heat that is supplied to the air handling side heat exchanger 41 is excessive, the flow rate of the heat medium that flows through the air handling side heat exchanger 41 is reduced, so that the amount of heat that is supplied to the air handling side heat exchanger 41 can be reduced.

Further, in an aspect directed to a fourth air handling unit 4, any of the aspects directed to the first to third air handling units 4 may be additionally configured to further include an air handling unit control device 400 that controls the air handling side flow rate control device 42, and may be additionally configured in such a manner that the air handling unit control device 400 has a communication connection with a heat source side unit control device that controls a heat source side unit that heats or cools the heat medium used as a heat-conveying medium.

This configuration allows the air handling unit control device 400 and the heat source side unit control device to transmit and receive information to and from each other, and the air handling unit 4 and the heat source side unit are thus allowed to exercise cooperative control. Note here that an example of the cooperative control is the exercise of control by the heat source side unit control device of a piece of equipment mounted in the heat source side unit on the basis of information pertaining to the status of the air handling unit 4 or the exercise of control by the air handling unit control device 400 of a piece of equipment mounted in the air handling unit 4 on the basis of information pertaining to the status of the heat source side unit.

Further, in an aspect directed to a fifth air handling unit 4, the aspect directed to the fourth air handling unit 4 may be additionally configured to further include an air handling side amount-of-heat detection device that detects an amount of heat that is exchanged in the air handling side heat exchanger 41, and may be additionally configured in such a manner that the air handling unit control device 400 transmits, to the heat source side unit control device, data pertaining to the amount of heat that is exchanged in the air handling side heat exchanger 41 detected by the air handling side amount-of-heat detection device. This configuration allows the heat source side unit control device to exercise control of the heat source side unit on the basis of the amount of heat that is exchanged at the air handling side heat exchanger 41. This thus makes it possible to perform more efficient heat supply.

Further, in an aspect directed to a sixth air handling unit 4, the aspect directed to the fifth air handling unit 4 may be additionally configured in such a manner that the air handling side amount-of-heat detection device includes an air handling inlet side temperature sensor 515 that detects a temperature of the heat medium that flows into the air handling side heat exchanger 41, an air handling outlet side temperature sensor 516 that detects a temperature of the heat medium that flows out from the air handling side heat exchanger 41, and the air handling unit control device 400, and the air handling unit control device 400 calculates, on the basis of the temperature detected by the air handling outlet side temperature sensor 516 and the flow rate of the heat medium that passes through the air handling side heat exchanger 41, the amount of heat that is exchanged in the air handling side heat exchanger 41, and transmits the amount of heat thus calculated to the heat source side unit control device. This configuration makes it possible to more accurately calculate, on the basis of the temperature of the heat medium that flows into the air handling side heat exchanger 41, the temperature of the heat medium that flows out from the air handling side heat exchanger 41, and the flow rate of the heat medium that passes through the air handling side heat exchanger 41, the amount of heat that is exchanged in the air handling side heat exchanger 41.

Further, in an aspect directed to a seventh air handling unit 4, the aspect directed to the sixth air handling unit 4 may be additionally configured in such a manner that the air handling side flow rate control device 42 is a valve whose opening degree is adjustable, the air handling side amount-of-heat detection device includes an air handling inlet side pressure sensor 523 that detects a pressure of the heat medium that flows into the air handling side heat exchanger 41, and an air handling outlet side pressure sensor 524 that detects a pressure of the heat medium that flows out from the air handling side heat exchanger 41, and the air handling unit control device 400 calculates, on the basis of a differential pressure between the pressure detected by the air handling inlet side pressure sensor 523 and the pressure detected by the air handling outlet side pressure sensor 524 and the opening degree of the air handling side flow rate control device 42, the flow rate of the heat medium that passes through the air handling side heat exchanger 41.

With this configuration, the flow rate of the heat medium that passes through the air handling side heat exchanger 41 is calculated on the basis of the differential pressure between the pressure at the inflow port and the pressure at the outflow port of the air handling side heat exchanger 41 and the opening degree of the air handling side flow rate control device 42. This makes it possible to calculate the flow rate with inexpensive pressure sensors without using an expensive flowmeter. This thus makes it possible to reduce the cost of the air handling unit 4.

Further, in an aspect directed to an eighth air handling unit 4, any of the aspects directed to the fourth to seventh air handling units 4 may be additionally configured in such a manner that in a case where an amount of heat required by the air handling side heat exchanger 41 is larger than an amount of heat detected by the air handling side amount-of-heat detection device and an upper limit of a flow rate that is adjustable by the air handling side flow rate control device 42 is reached, the air handling unit control device 400 transmits, to a heat source side unit control device that controls an amount of heating or an amount of cooling that the heat source side unit supplies to the heat medium, a signal that requests the heat source side unit control device to increase the amount of heating or the amount of cooling that is supplied to the heat medium.

With this configuration, even in a case where the amount of heat required by the air handling side heat exchanger 41 cannot be attained by the adjustment of the flow rate by the air handling side flow rate control device 42, the heat source side unit increases the amount of heating or the amount of cooling that is imparted to the heat medium, so that the amount of heat required by the air handling side heat exchanger 41 can be more surely attained.

The invention claimed is:

1. An air-conditioning apparatus, comprising:

a heat source side unit configured to heat or cool a heat medium used as a heat-conveying medium;

an air handling side heat exchanger that exchanges heat between outside air that is sent into a building and the heat medium; and an indoor side heat exchanger that exchanges heat between indoor air and the heat medium, wherein the heat source side unit, the air handling side heat exchanger, and the indoor side heat exchanger are connected by piping to each other to form a heat medium cycle circuit through which the heat medium circulates, in the heat medium cycle circuit, a portion of the heat medium heated or cooled by the heat source side unit flows into the indoor side heat exchanger after having passed through the air handling side heat exchanger, the heat medium cycle circuit is provided with an air handling side flow rate control valve configured to adjust a flow rate of the heat medium that passes through the air handling side heat exchanger, and the air-conditioning apparatus further comprises an air handling side amount-of-heat detection device configured to detect an amount of heat that is exchanged in the air handling side heat exchanger, wherein the air handling side amount-of-heat detection device includes an air handling inlet side temperature sensor configured to detect a temperature of the heat medium that flows into the air handling side heat exchanger, an air handling outlet side temperature sensor configured to detect a temperature of the heat medium that flows out from the air handling side heat exchanger, an air handling inlet side pressure sensor configured to detect a pressure of the heat medium that flows into the air handling side heat exchanger, an air handling outlet side pressure sensor configured to detect a pressure of the heat medium that flows out from the air handling side heat exchanger, and an air handling unit controller configured to calculate, on a basis of the temperature detected by the air handling inlet side temperature sensor, the temperature detected by the air handling outlet side temperature sensor, the pressure detected by the air handling inlet side pressure sensor, the pressure detected by the air handling outlet side pressure sensor, and an opening degree of the air handling side flow rate control valve, an amount of heat that is exchanged in the air handling side heat exchanger, wherein, in a case where an amount of heat required by the air handling side heat exchanger is larger than the amount of heat that is exchanged in the air handling side heat exchanger and an upper limit of a flow rate that is adjustable by the air handling side flow rate control valve is reached, a heat source side unit controller configured to control an amount of heating or an amount of cooling that the heat source side unit supplies to the heat medium controls the heat source side unit to increase an amount of heating or an amount of cooling that is imparted to the heat medium.

2. The air-conditioning apparatus of claim 1, wherein another portion of the heat medium heated or cooled by the heat source side unit flows into the indoor side heat exchanger without passing through the air handling side heat exchanger, and the air handling side flow rate control valve is configured to adjust a ratio between a flow rate of the heat medium that flows into the indoor side heat exchanger through the air handling side heat exchanger and a flow rate of the heat medium that flows into the indoor side heat exchanger without passing through the air handling side heat exchanger.

3. The air-conditioning apparatus of claim 2, wherein a portion of the heat medium heated or cooled by the heat source side unit that has passed through the air handling side heat exchanger and another portion of the heat medium heated or cooled by the heat source side unit that does not pass through the air handling side heat exchanger flow into the indoor side heat exchanger after having converged at a pipe that connects the air handling side heat exchanger with the indoor side heat exchanger.

4. The air-conditioning apparatus of claim 1, wherein the heat medium cycle circuit includes a bypass pipe by which a pipe that connects the heat source side unit with the air handling side heat exchanger and a pipe that connects the air handling side heat exchanger with the indoor side heat exchanger are connected to each other, without connecting through the air handling side heat exchanger, and the air handling side flow rate control valve is configured to adjust a ratio between a flow rate of the heat medium that flows into the indoor side heat exchanger through the air handling side heat exchanger and a flow rate of the heat medium that flows into the indoor side heat exchanger through the bypass pipe.

5. The air-conditioning apparatus of claim 1, wherein the heat source side unit includes a compressor configured to compress heat source side refrigerant, a heat source side heat exchanger that exchanges heat between the heat source side refrigerant and air, an expansion valve configured to decompress the heat source side refrigerant, and a heat medium heat exchanger that exchanges heat between the heat source side refrigerant and the heat medium, and the compressor, the heat source side heat exchanger, the expansion valve, and the heat medium heat exchanger are connected by piping to one another to form a heat source side refrigerant cycle circuit.

6. The air-conditioning apparatus of claim 1, further comprising an outside temperature sensor configured to detect a temperature of outside, wherein when a difference between the temperature of the outside air and a predetermined air handling side set temperature increases, the air handling unit controller controls the air handling side flow rate control valve to increase a flow rate of the heat medium that flows through the air handling side heat exchanger.

7. The air-conditioning apparatus of claim 1, wherein the air handling unit controller is configured to control the air handling side flow rate control valve to adjust, on a basis of an amount of heat that is exchanged in the air handling side heat exchanger and an amount of heat required by the air handling side heat exchanger, a flow rate of the heat medium that flows through the air handling side heat exchanger.

8. The air-conditioning apparatus of claim 1, further comprising an indoor side flow rate control valve configured to adjust a flow rate of a heat medium that flows into and out from the indoor side heat exchanger;

an indoor inlet side temperature sensor configured to detect a temperature of the heat medium that flows into the indoor side heat exchanger;

an indoor outlet side temperature sensor configured to detect a temperature of the heat medium that flows out from the indoor side heat exchanger;

an indoor inlet side pressure sensor configured to detect a pressure of a heat medium that flows into the indoor side flow rate control valve;

an indoor outlet side pressure sensor configured to detect a pressure of a heat medium that flows out from the indoor side flow rate control device;

an indoor unit controller configured to calculate, on a basis of the temperature detected by the indoor inlet side temperature sensor, the temperature detected by the indoor outlet side temperature sensor, the pressure detected by the indoor inlet side pressure sensor, the pressure detected by the indoor outlet side pressure sensor, and an opening degree of the indoor side flow rate control valve, an amount of heat that is exchanged in the indoor side heat exchanger;

wherein the heat source side unit controller changes, on a basis of a sum of an amount of heat that is exchanged in the air handling side heat exchanger and an amount of heat that is exchanged in the indoor side heat exchanger, an amount of heating or an amount of cooling that is imparted to the heat medium by the heat source side unit.

9. The air-conditioning apparatus of claim 1, further comprising:

an air handling unit housing that houses the air handling side flow rate control valve, the air handling side heat exchanger, and the air handling unit controller, wherein the air handling unit controller and the heat source side unit controller have a communication connection with each other.

10. The air-conditioning apparatus of claim 1, further comprising an auxiliary heat source side unit configured to raise or lower a temperature of the heat medium that is to flow into the indoor side heat exchanger after passing through the air handling side heat exchanger.

11. The air-conditioning apparatus of claim 10, wherein the auxiliary heat source side unit is configured to heat or cool the heat medium, and the heat medium that is to flow into the indoor side heat exchanger after passing through the air handling side heat exchanger flows into the indoor side heat exchanger after converging with the heat medium heated or cooled by the auxiliary heat source side unit.

12. The air-conditioning apparatus of claim 1, wherein the air handling unit controller determines whether the upper limit of the flow rate that is adjustable by the air handling side flow rate control valve is reached.

13. The air-conditioning apparatus of claim 1, wherein the air handling unit controller determines that the upper limit of the flow rate that is adjustable by the air handling side flow rate control valve is reached when the opening degree of the air handling side flow rate control valve is at its maximum.

14. An air handling unit, comprising:

an air handling side heat exchanger that exchanges heat between air that is sent from outside a targeted space into the targeted space and a portion of a heat medium heated or cooled by a heat source side unit;

an air handling side amount-of-heat detection device configured to detect an amount of heat that is exchanged in the air handling side heat exchanger; and an air handling side flow rate control valve configured to adjust a flow rate of the heat medium that passes through the air handling side heat exchanger, wherein the heat medium subjected to heat exchange by the air handling side heat exchanger flows into an indoor side heat exchanger that exchanges heat between indoor air and the heat medium, and the air handling side amount-of-heat detection device includes an air handling inlet side temperature sensor configured to detect a temperature of the heat medium that flows into the air handling side heat exchanger, an air handling outlet side temperature sensor configured to detect a temperature of the heat medium that flows out from the air handling side heat exchanger, an air handling inlet side pressure sensor configured to detect a pressure of the heat medium that flows into the air handling side heat exchanger, an air handling outlet side pressure sensor configured to detect a pressure of the heat medium that flows out from the air handling side heat exchanger, and an air handling unit controller configured to calculate, on a basis of the temperature detected by the air handling inlet side temperature sensor, the temperature detected by the air handling outlet side temperature sensor, the pressure detected by the air handling inlet side pressure sensor, the pressure detected by the air handling outlet side pressure sensor, and an opening degree of the air handling side flow rate control valve, an amount of heat that is exchanged in the air handling side heat exchanger, wherein, in a case where an amount of heat required by the air handling side heat exchanger is larger than the amount of heat that is exchanged in the air handling side heat exchanger and an upper limit of a flow rate that is adjustable by the air handling side flow rate control valve is reached, a heat source side unit controller configured to control an amount of heating or an amount of cooling that the heat source side unit supplies to the heat medium controls the heat source side unit to increase an amount of heating or an amount of cooling that is imparted to the heat medium.

15. The air handling unit of claim 14, further comprising:

an inlet through which the heat medium heated or cooled by the heat source side unit flows;

an inward path pipe that connects the inlet with the air handling side heat exchanger;

an outlet through which the heat medium subjected to heat exchange by the air handling side heat exchanger flows out;

an outward path pipe that connects the outlet with the air handling side heat exchanger; and a bypass pipe that connects the inward path pipe with the outward path pipe without connecting through the air handling side heat exchanger, wherein the air handling side flow rate control valve is configured to adjust a ratio between a flow rate of the heat medium that flows from the inlet to the air handling side heat exchanger and a flow rate of the heat medium that flows from the inlet to the bypass pipe.

16. The air handling unit of claim 14, wherein the air handling unit controller is configured to control the air handling side flow rate control valve to adjust, on a basis of an amount of heat that is exchanged in the air handling side heat exchanger and an amount of heat required by the air handling side heat exchanger, a flow rate of the heat medium that flows through the air handling side heat exchanger.

17. The air handling unit of claim 14, wherein the air handling unit controller has a communication connection with the heat source side unit controller.

18. The air handling unit of claim 17, wherein the air handling unit controller is configured to transmit, to the heat source side unit controller, data pertaining to the amount of heat that is exchanged in the air handling side heat exchanger, the amount of heat being detected by the air handling side amount-of-heat detection device.

* * * * *